US007432882B2

(12) United States Patent
Kosaka et al.

(10) Patent No.: US 7,432,882 B2
(45) Date of Patent: Oct. 7, 2008

(54) DRIVING CIRCUIT FOR PLASMA DISPLAY PANEL USING OFFSET WAVEFORM

(75) Inventors: Tadayoshi Kosaka, Kawasaki (JP); Yoshiho Seo, Kawasaki (JP); Koichi Sakita, Kawasaki (JP); Kenji Awamoto, Kawasaki (JP)

(73) Assignee: Hitachi, Ltd., Tokyo (JP)

( * ) Notice: Subject to any disclaimer, the term of this patent is extended or adjusted under 35 U.S.C. 154(b) by 105 days.

(21) Appl. No.: 10/563,943

(22) PCT Filed: Jul. 15, 2003

(86) PCT No.: PCT/JP03/08953

§ 371 (c)(1),
(2), (4) Date: Jan. 3, 2007

(87) PCT Pub. No.: WO2005/006289

PCT Pub. Date: Jan. 20, 2005

(65) Prior Publication Data

US 2007/0091023 A1 Apr. 26, 2007

(51) Int. Cl.
*G09G 3/28* (2006.01)

(52) U.S. Cl. ..... 345/68; 345/60

(58) Field of Classification Search ..... 345/37, 345/41–42, 53, 60–68; 315/169.4
See application file for complete search history.

(56) References Cited

U.S. PATENT DOCUMENTS 6,633,285 B1 * 10/2003 Kigo et al. ..... 345/204
6,844,685 B2 * 1/2005 Lee ..... 315/169.3
7,109,662 B2 * 9/2006 Sakita ..... 315/169.3

FOREIGN PATENT DOCUMENTS

| | | |
|---|---|---|
| JP | 50-39024 | 4/1975 |
| JP | 52-150940 | 12/1977 |
| JP | 52-150941 | 12/1977 |
| JP | 3-259183 | 11/1991 |
| JP | 4-267293 | 9/1992 |
| JP | 6-274125 | 9/1994 |
| JP | 11-352927 | 12/1999 |
| JP | 2000-181404 | 6/2000 |
| JP | 2001-13919 | 1/2001 |
| JP | 2001-56666 | 2/2001 |
| JP | 2001-75528 | 3/2001 |
| JP | 2002-215089 | 7/2002 |
| JP | 2002-351389 | 12/2002 |

* cited by examiner

*Primary Examiner*—Bipin Shalwala
*Assistant Examiner*—Mansour M Said
(74) *Attorney, Agent, or Firm*—Staas & Halsey LLP

(57) ABSTRACT

A sustain voltage applying circuit includes a circuit having a sustain pulse generating circuit for generating a sustain pulse of a predetermined waveform and an offset pulse generating circuit for generating an offset pulse higher in peak value than the sustain pulse, the sustain pulse generating circuit and the offset pulse generating circuit being connected in parallel, the offset pulse generating circuit including a first voltage source, a first switching circuit, an inductance component for generating a resonance voltage for the offset pulse generation, and a forward diode for permitting a current supplied to the display electrodes to flow forward so that the resonance voltage is maintained at a higher voltage level than a voltage level of a sustain voltage for a predetermined period of time, the sustain pulse generating circuit including a second voltage and a second switching circuit.

8 Claims, 21 Drawing Sheets

DRIVING CIRCUIT FOR PLASMA DISPLAY PANEL USING OFFSET WAVEFORM

TECHNICAL FIELD

The present invention relates to a driving circuit for a plasma display panel (hereinafter referred to as a PDP), and more particularly to a driving circuit for a PDP which is designed to superpose an offset voltage on a voltage pulse applied to display electrodes at a sustain discharge. PDPs are characterized by their slim and large screens and are commercially available as public display monitors.

BACKGROUND ART

As PDPs, surface discharge AC-type PDPs with three electrodes have been widely known. These PDPs have a number of surface dischargeable display electrodes arranged in a horizontal direction on an inner surface of a front side (display surface side) substrate and a number of selective electrodes (also referred to as address electrodes or data electrodes) arranged in a perpendicular direction on an inner surface of a rear side substrate. The front- and rear-side substrates are disposed to face each other and the periphery of the substrates is sealed to form a discharge space inside. Portions where the display electrodes and the address electrodes intersect each other serve as cells.

The display electrodes are constituted of Y electrodes used for selecting a cell to be lit and X electrodes for applying the same voltage to all cells. The Y electrodes and X electrodes are alternately arranged.

In the PDPs of this structure, a driving method generally called an address/display separation method is employed for gradation display. In other words, one frame is divided into a plurality of subfields to which weights are assigned. Each subfield includes an address period for selecting a cell to be lit and a sustain period for causing the selected cell to emit light.

For display, while the Y electrodes are used as scan electrodes to scan a screen, a voltage (generally referred to as an address voltage) is applied to a desired address electrode to generate an address discharge between the Y electrode and the address electrode so that charges are formed in a cell to be lit. Then, voltages for display (generally referred to as sustain voltages) are alternately applied to the X and Y electrodes to repeat sustain discharges between the X and Y electrodes for the number of times corresponding to the weight assigned to a subfield.

As a waveform of voltages applied at the sustain discharge, such rectangular waves as shown in FIG. 27 are usually employed, and a method of alternately applying the rectangular waves is common. As a modified example of such rectangular waves, an offset waveform shown in FIG. 28 may be used in order to increase the driving margin or improve the light emission efficiency.

The offset waveform is a voltage waveform in which an offset voltage is superposed on a rectangular wave, and is known from the disclosure of, for example, Japanese Unexamined Patent Publication No. SHO 52-150941, Japanese Unexamined Patent Publication No. SHO 52-150940, Japanese Unexamined Patent Publication No. SHO 50-39024, Japanese Unexamined Patent Publication No. HEI 3-259183 and Japanese Unexamined Patent Publication No. HEI 4-267293.

Furthermore, a circuit for forming such an offset waveform is disclosed in Japanese Unexamined Patent Publication No. 2001-13919. The circuit disclosed in this publication is as shown in FIG. 29. The circuit for forming an offset waveform will be described below.

In the circuit of FIG. 29, a condenser C signifies a panel capacity of a PDP. A resistance R is a line resistance, and an inductor L1 together with the condenser C forms a resonance circuit. A source of voltage Vo applies an offset voltage, and a source of voltage Vs applies a rectangular wave. Switches SW1 and SW2 control application timing of voltages Vo and Vs, respectively.

FIG. 30 is a timing diagram of switches SW1 and SW2. In the figure, t1 indicates a time when a wave starts to rise, t2 indicates a time when the maximum voltage is reached, and t3 indicates a time when the voltage is at Vs.

The maximum light emission efficiency can be obtained on the condition that a discharge starts when the voltage is at the maximum, and where tf is a discharge start time, the optimum value can only be obtained at a moment when tf=t2.

Exemplary diagrams in which the discharge start time does not match the optimum value are shown in FIGS. 31 and 32.

FIG. 31 is a timing diagram when tf>t3. In this diagram, since a discharge starts at a voltage Vs, the light emission efficiency is equivalent to that when an offset waveform is not applied and a usual rectangular wave is applied. Furthermore, the light emission efficiency is lower than that when tf=t2.

FIG. 32 is a timing diagram when tf<t3. In this diagram, since a discharge starts in the middle of wave rise, a discharge takes place without a sufficient voltage being applied due to a voltage drop associated with the discharge. For this reason, the light emission efficiency is lower than that when tf=t2.

The maximum light emission efficiency is achieved when tf=t2. Where t2>tf>t3, the light emission efficiency decreases as the discharge start time tf becomes late.

As described above, in plasma display using an offset voltage, there is an optimum range for the relationship between application timing of the offset waveform and discharge start time, and if the relationship is not in an appropriate range, the light emission efficiency decreases.

With respect to the relationship between offset waveform application timing and discharge start time, conventional circuits have a problem that rise timing and fall timing of the offset waveform depend on the time constant of LC resonance, and thereby the adjustment of timings is difficult. Since the discharge start time tf changes in accordance with the amount of priming particles which varies with a display state, display panels operate unstably with conventional circuits.

The present invention has been made in view of such circumstances and an object thereof is to improve the light emission efficiency of a plasma display panel by adding a mechanism of freely adjusting rise timing and fall timing of an offset voltage waveform in accordance with discharge timing.

DISCLOSURE OF INVENTION

The present invention provides a driving circuit for a plasma display panel including a plurality of cells each having a pair of display electrodes covered with a dielectric layer, the driving circuit comprising: a scan circuit for selecting a cell to be lit; and a sustain voltage applying circuit for applying a sustain voltage between the display electrodes of the selected cell so that sustain discharges are generated between the display electrodes for the number of times corresponding to a light intensity, the sustain voltage applying circuit including a sustain pulse generating circuit for generating a sustain pulse of a predetermined waveform and an offset pulse generating circuit for generating an offset pulse higher in peak value than the sustain pulse, the sustain pulse generating circuit and the offset pulse generating circuit being connected in parallel, wherein the offset pulse generating circuit includes a source of a first voltage for applying a offset voltage, a first switching circuit for applying the first voltage between the display electrodes, an inductance component of generating a resonance voltage for applying the offset voltage, and a forward diode for permitting a current supplied to the display electrodes to flow forward so that the resonance voltage is maintained at a higher voltage level than a voltage level of the sustain voltage for a predetermined period of time, and the sustain pulse generating circuit includes a source of a second voltage for applying a sustain voltage and a second switching circuit for applying the second voltage between the display electrodes.

According to the present invention, the offset pulse generating circuit is provided with the reverse diode for maintaining the resonance voltage at a higher voltage level than the voltage level of the sustain voltage for a predetermined period of time, which allows the voltage level of an offset pulse to be maintained for a given period of time by appropriately setting switching timing of the first and second switching circuits. Thus, a discharge can be started in a state in which the voltage applied to the display electrodes is at the maximum (a state in which the offset pulse is applied), whereby the discharge between the display electrodes can be generated at high light emission efficiency.

BEST MODE FOR CARRYING OUT THE INVENTION

Figure 1:
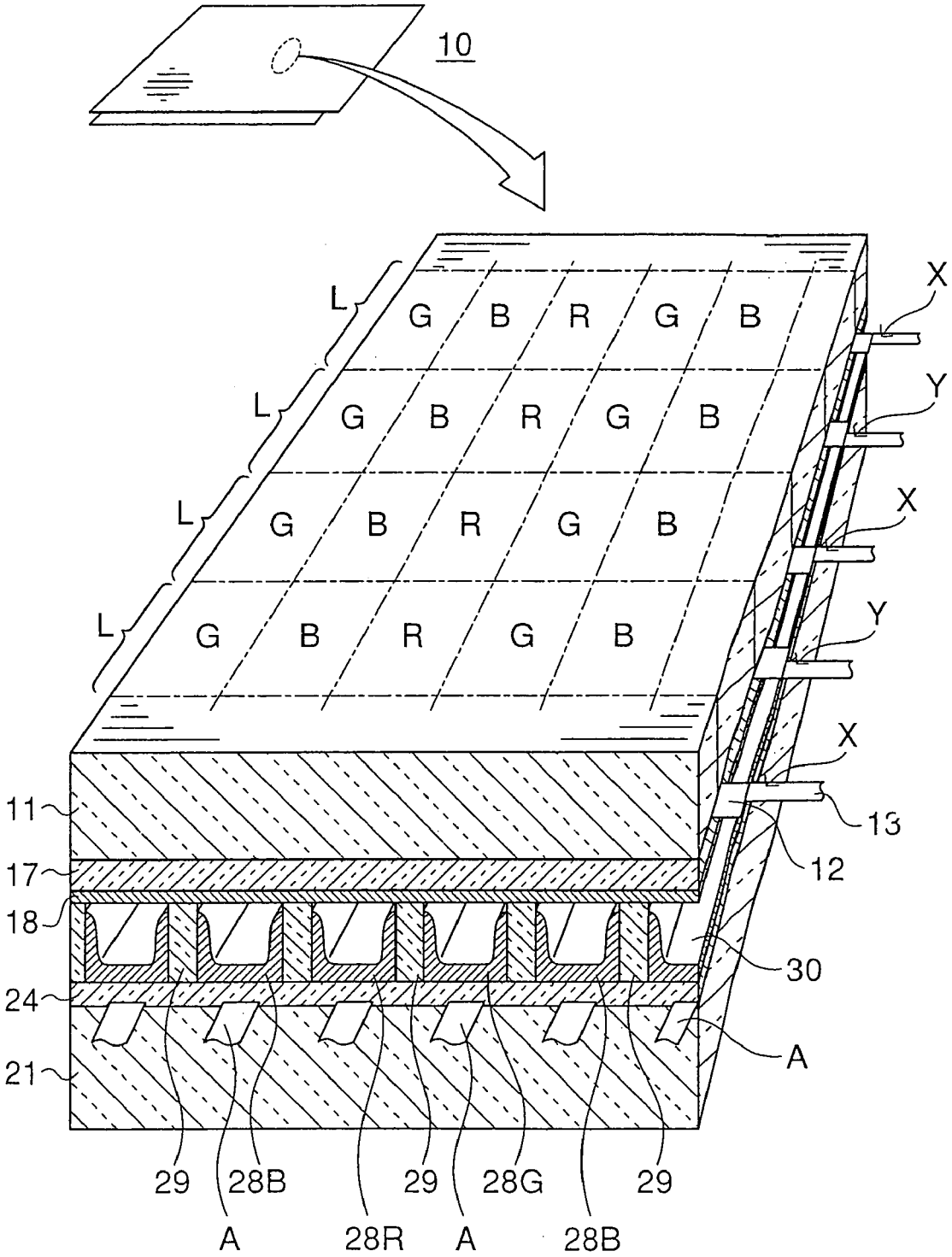
FIG. 1 is a partial exploded perspective view of the construction of a PDP to which a driving circuit of the invention is applied.

In the present invention, front-side and rear-side panel assemblies are formed by forming electrodes on substrates and covering the electrodes with a dielectric layer. The panel assemblies are disposed to face each other to form a discharge space therein, and the discharge space is partitioned with barrier ribs to form a number of cells. By forming the number of cells in this manner, each cell can be constructed to have a pair of display electrodes covered with the dielectric layer.

Examples of the substrates include those of glass, quartz, ceramic or the like with or without desired elements such as electrodes, an insulating film, a dielectric layer, a protective film or the like formed thereon.

The electrodes can be formed using various materials and methods known in the field. Examples of the materials usable for the electrodes include transparent conductive materials such as ITO, $SnO_2$ and the like, and metal conductive materials such as Ag, Au, Al, Cu, Cr and the like. As a method for forming the electrodes, various methods known in the field can be employed. For example, the electrodes can be formed using a thick-film forming technique such as printing, or a thin-film forming technique such as a physical accumulation method or a chemical accumulation method. As the thick-film forming technique, a screen printing method or the like can be employed. Among the thin-film forming technique, a vapor deposition method or a sputtering method can be employed as the physical accumulation method, and a thermal CVD method, a photo CVD method or a plasma CVD method can be employed as the chemical accumulation method.

Any driving circuit may be used as long as it includes a scan circuit for selecting a cell to be lit and a sustain voltage applying circuit for applying a sustain voltage between the display electrodes in the selected cell to generate a sustain discharge between the display electrodes for the number of times corresponding to a light intensity.

Any sustain voltage applying circuit may be used as long as it includes a sustain pulse generating circuit for generating a sustain pulse of a predetermined waveform and an offset pulse generating circuit for generating an offset pulse higher in peak value than the sustain pulse which are connected in parallel.

Any offset pulse generating circuit may be used as long as it includes a first voltage source for outputting a first voltage for offset voltage generation, a first switching circuit for switching on or off a circuit which applies the first voltage between the display electrodes, an inductance component for generating a resonance voltage for the offset voltage generation, and a forward diode for permitting a current supplied to the display electrodes to flow forward so that the resonance voltage is maintained at a higher voltage level than the voltage level of the sustain voltage for a predetermined period of time.

Any sustain pulse generating circuit may be used as long as it includes a second voltage source for outputting a second voltage for sustain voltage generation and a second switching circuit for switching on or off a circuit which applies the second voltage between the display electrodes.

As the first voltage source for outputting a first voltage for offset voltage generation and the second voltage source for outputting a second voltage for sustain voltage generation, voltage sources known in the field can be used.

As the first and second switching circuits, switching circuits using a transistor known in the field can be used.

Any inductance component may be used as long as it can generate a resonance voltage for an offset pulse. By the resonance voltage is meant an LC resonance voltage generated by the action of an inductance component L and a capacitance component C of the display electrodes.

Any forward diode may be used as long as it can permit a current supplied to the display electrodes to flow forward so that the resonance voltage is maintained at a higher voltage level than a voltage level of the sustain voltage for a predetermined period of time. The forward diode is not limited as long as it has the above-mentioned function, and any diode may be used.

The present invention will hereinafter be described by way of embodiments shown in the attached drawings. However, the present invention should not be limited to these embodiments, and various modifications can be made.

FIG. 1 is a partial exploded perspective view of the construction of a PDP to which a driving circuit of the invention is applied. The PDP is a surface discharge AC-type PDP with three electrodes for color display.

The PDP has a front side (display surface side) panel assembly including a front side substrate 11 and a rear side panel assembly including a rear side substrate 21. As the front- and rear-side substrates 11 and 21, glass substrates, quartz substrates, ceramic substrates or the like can be used.

On an inner surface of the front side substrate 11, display electrodes X and display electrodes Y are formed equidistantly in a horizontal direction. All lines defined between the display electrodes X and Y and between the display electrodes Y and X serve as display lines L. The display electrodes X and Y each has a transparent electrode 12 with a large width made of ITO, $SnO_2$ or the like and a metal bus electrode 13 with a small width made of, for example, Ag, Au, Al, Cu, Cr or a multilayer structure of these (e.g., a multilayer structure of Cr/Cu/Cr). The display electrodes X and Y can be formed by, when using Ag or Au, a thick-film forming technique such as screen printing, or by, when using other materials, a thin-film forming technique such a vapor deposition method, a sputtering method or the like and an etching technique so that a desired number of electrodes can be formed with a desired thickness, width and interval.

On the display electrodes X and Y, a dielectric layer 17 for AC driving is formed so as to cover the display electrodes X and Y. The dielectric layer 17 is formed by applying a low-melting glass paste to the front side substrate 11 by a screen printing method and sintering the paste.

On the dielectric layer 17, a protective film 18 for protecting the dielectric layer 17 from damages caused by collision of ions generated by discharges at the display. The protective film may be formed of, for example, MgO, CaO, SrO, BaO or the like.

On an inner surface of the rear side substrate 21, a plurality of address electrodes A are formed in a direction that intersects the display electrodes X and Y when seen from the top, and a dielectric layer 24 is formed so as to cover the address electrodes A. The address electrodes A generate an address discharge for selecting a cell to be lit at intersections between the display electrodes for scanning and the address electrodes. Each of the address electrodes A is formed of a three-layer structure of Cr/Cu/Cr. Alternatively, each address electrode A may be formed of Ag, Au, Al, Cu, Cr or the like. As in the case of the display electrodes X and Y, the address electrodes A can be formed by, when using Ag or Au, a thick-film forming technique such as screen printing, or by, when using other materials, a thin-film forming technique such as a vapor deposition method, a sputtering method or the like and an etching technique so that a desired number of electrodes can be formed with a desired thickness, width and interval. The dielectric layer 24 can be formed using the same material and method as those used for the formation of the dielectric layer 17.

On the dielectric layer 24, a plurality of barrier ribs 29 are formed between the address electrodes A. The barrier ribs 29 can be formed by a sandblasting method, a printing method, a photoetching method or the like. In the sandblasting method, for example, a glass paste formed of a low-melting glass frit, a binder resin, a solvent and the like is applied to the dielectric layer 24 and then dried. Subsequently, cutting particles are blasted onto the glass paste layer on which a cut mask having openings in the form of a rib pattern is disposed so that the exposed glass paste layer in the mask openings is cut, and then the layer is sintered again to form the ribs. In the photoetching method, instead of cutting the glass paste layer with the cutting particles, a photosensitive resin is used as the binder resin and after exposure and development using a mask, the resin is sintered to form the ribs.

On sides of the barrier ribs 29 and on the dielectric layer 24 between the barrier ribs 29, red (R), green (G) and blue (B) phosphor layers 28R, 28G and 28B are formed. The phosphor layers 28R, 28G and 28B are formed by applying a phosphor paste containing phosphor powder, a binder resin and a solvent to the inside of discharge spaces in the form of grooves provided between the barrier ribs 29 by screen printing or by a method using a dispenser, and after repeating the application for each color, sintering the pastes. Alternatively, the phosphor layers 28R, 28G and 28B can be formed by a photolithographic technique using a phosphor layer material in the form of a sheet (so called a green sheet) containing phosphor powder, a photosensitive material and a binder resin. In such a case, the sheet of a desired color is attached to an entire display area on the substrate and then subjected to exposure and development. This process is repeated for each color so that the phosphor layers of respective colors are formed in corresponding spaces between the ribs.

The PDP is fabricated by disposing the front and rear-side panel assemblies to face each other such that the display electrodes X and Y intersect the address electrodes A, sealing the peripheries of the panel assemblies and filling discharge spaces 30 surrounded by the barrier ribs with a discharge gas containing, for example, a mixture of Ne gas and Xe gas. In this PDP, each of the discharge spaces 30 at the intersections of display electrodes X, Y and the address electrodes A serves as the smallest display unit, that is, one cell region (unit light-emitting region). One pixel is constituted of three cells of R, G and B.

For display on a screen, one frame is constituted of a plurality of subfields, and a display period of each subfield is constituted of a selective period (hereinafter also referred to as an address period) for selecting a cell to be lit and a sustain period for making the selected cell to emit light.

In the address period, the Y electrodes are sequentially scanned to accumulate wall charges in a cell to be lit. In the sustain period, pulsed voltages are applied between the display electrodes in all of the cells for displaying an image on a screen. More specifically, in the address period, a scan voltage is sequentially applied to a group of Y electrodes used as scan electrodes while an address voltage is applied to a desired address electrode A to generate an address discharge between the selected address electrode A and Y electrode, whereby a cell to be lit is selected. As wall charges are formed on a portion of the dielectric layer corresponding the light-emitting cell, sustain voltages are applied alternately between the Y electrodes group and X electrodes group. Thus, a discharge (referred to as a sustain discharge or display discharge) is generated again in the cell where the wall charges are accumulated, and thereby the cell emits light. The light emission from the cell is caused by exciting a phosphor with ultraviolet rays generated by a display discharge, so that visible light of a desired color is generated from the phosphor.

Figure 2:
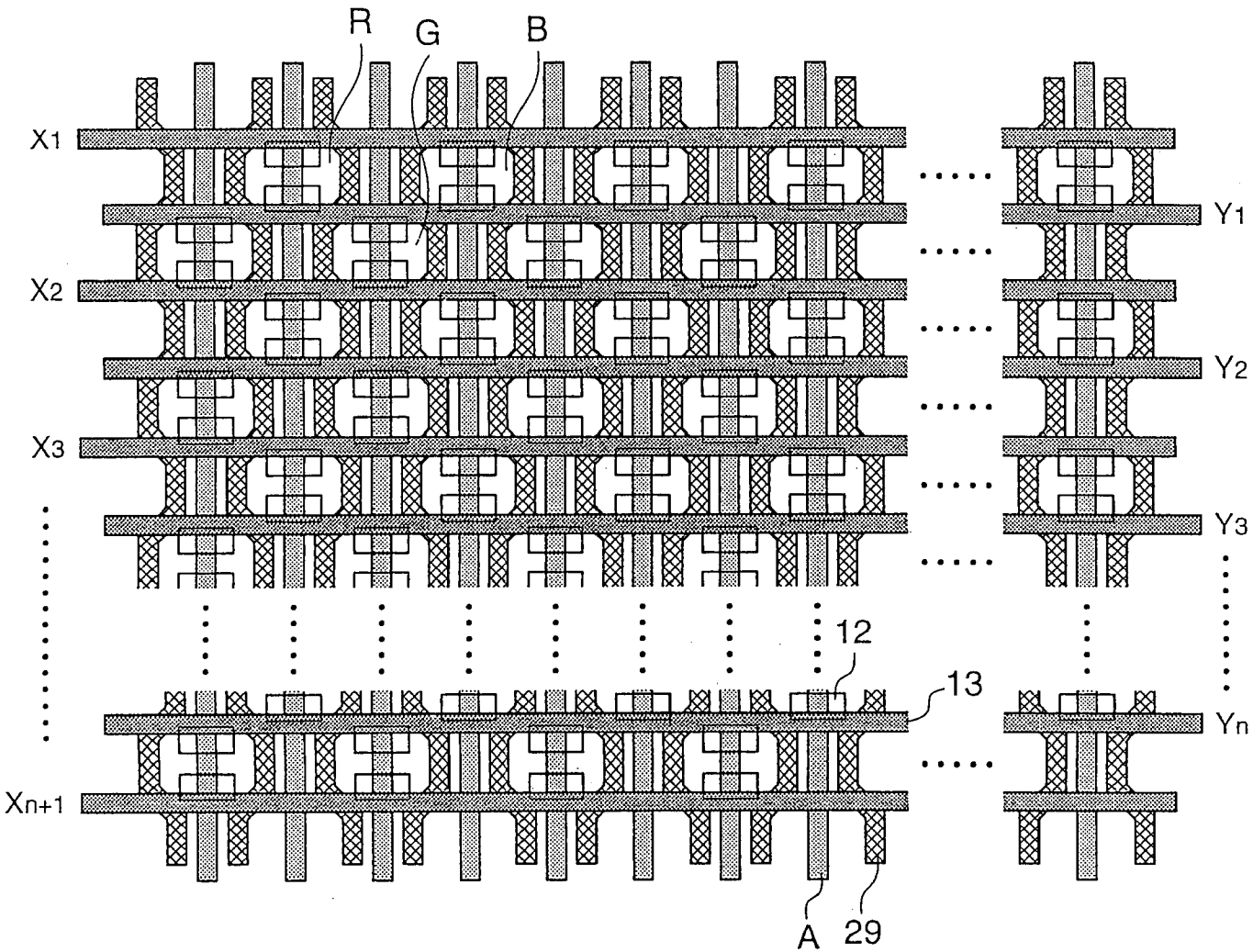
FIG. 2 is an illustrative view of the PDP as seen from the top.

FIG. 2 is an illustrative view of the PDP as seen from the top.

The PDP, as seen from the top, has a delta arrangement in which the barrier ribs 29 are formed in a winding manner and three cells of R, G, B arranged in a triangle form one pixel. Each of the R, G, B cells has a almost hexagonal honeycomb structure.

The X and Y electrodes are equidistantly arranged and are constructed to be capable of generating a surface discharge between all of the transparent electrodes, that is, between the X and Y electrodes and between the Y and X electrodes.

Figure 3:
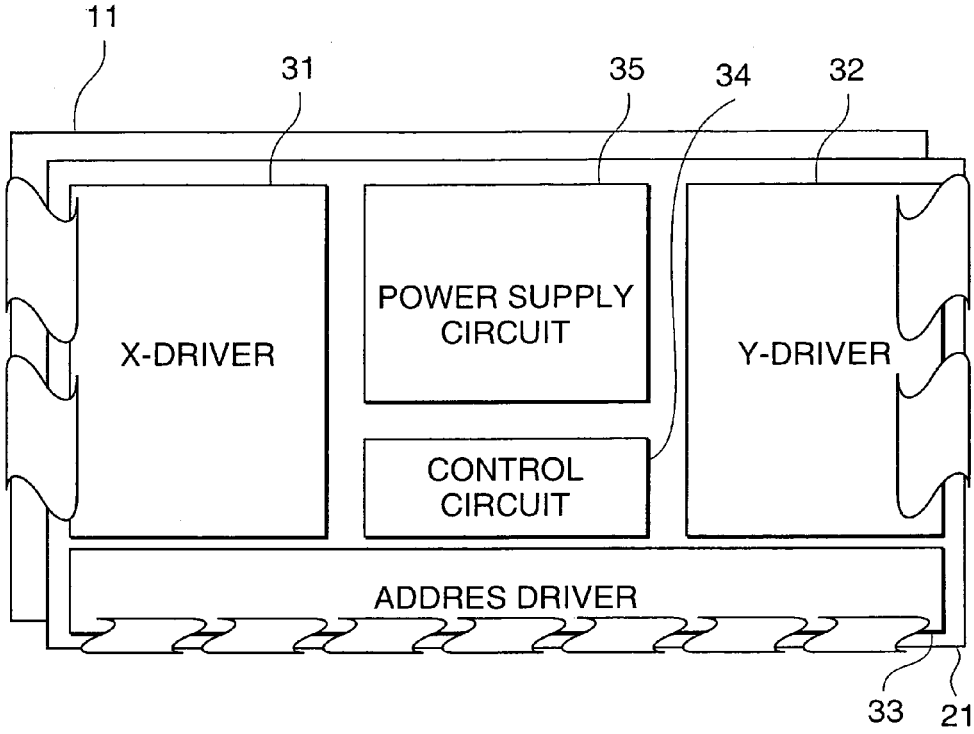
FIG. 3 is an illustrative view of the arrangement inside a driving apparatus including the driving circuit of the invention.

FIG. 3 is an illustrative view of the arrangement inside a driving apparatus. This figure shows the PDP as seen from the rear surface. The driving apparatus is disposed on the rear surface of the PDP and includes an X-driver 31, a Y-driver 32, an address driver 33, a control circuit 34 and a power supply circuit 35.

Figure 4:
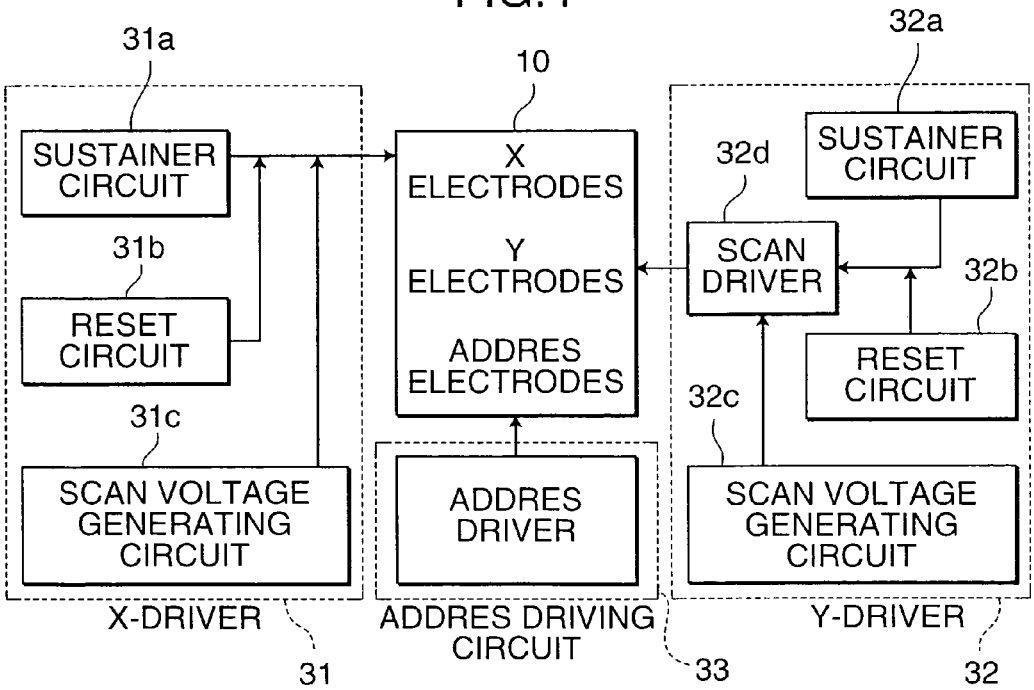
FIG. 4 is a block diagram of the driving apparatus.

FIG. 4 is a block diagram of the driving apparatus. The X-driver 31 includes a sustainer circuit 31*a*, a reset circuit 31*b* and a scan voltage generating circuit 31*c*. The sustainer circuit 31*a* is a circuit for applying a sustain voltage to the X electrodes. The reset circuit 31*b* is a circuit for initializing all of the cells at one time.

The Y-driver 32 includes a sustainer circuit 32*a*, a reset circuit 32*b*, a scan voltage generating circuit 32*c* and a scan driver 32*d*. The sustainer circuit 32*a* is a circuit for applying a sustain voltage to the Y electrodes. The reset circuit 32*b* is a circuit for initializing all of the cells at one time. The scan driver 32*d* is a circuit for scanning the Y electrodes.

Among the above components, the present invention relate to the sustainer circuits 31*a* and 32*a*. Conventionally known circuits are used for the other circuits.

Embodiments of the sustainer circuits 31*a* and 32*a* will be described hereinbelow. Since the sustainer circuits 31*a* and 32*a* are the same circuit, they will be referred simply to as a sustainer circuit.

Embodiment 1

Figure 5:
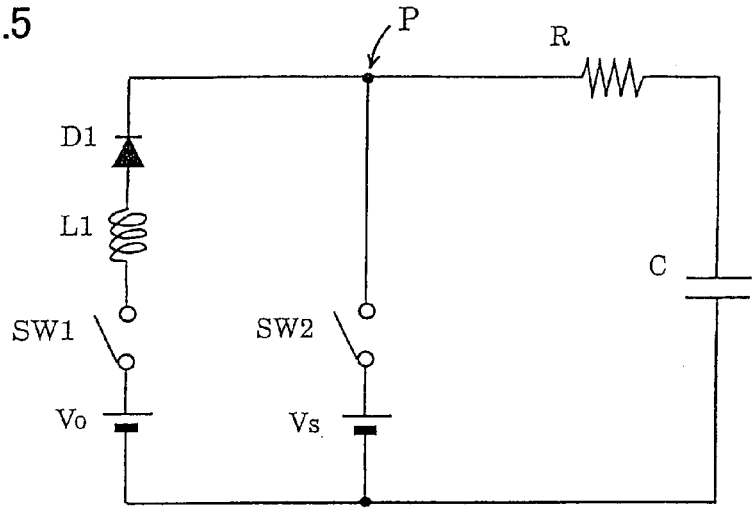
FIG. 5 an illustrative view of circuit principles of a sustainer circuit according to the first embodiment of the invention.

FIG. 5 is an illustrative view of circuit principles of a sustainer circuit according to the first embodiment of the invention.

In the figure, a condenser C is a capacitance component and is a panel capacity of a PDP. A resistance R is a line resistance. An inductor L1 is an inductance component and together with the condenser C, forms a resonance circuit. A source of voltage Vo applies an offset voltage, and a source of voltage Vs applies a rectangular wave. Switches SW1 and SW2 control application timing of a voltage Vo and a voltage Vs, respectively.

Figure 29:
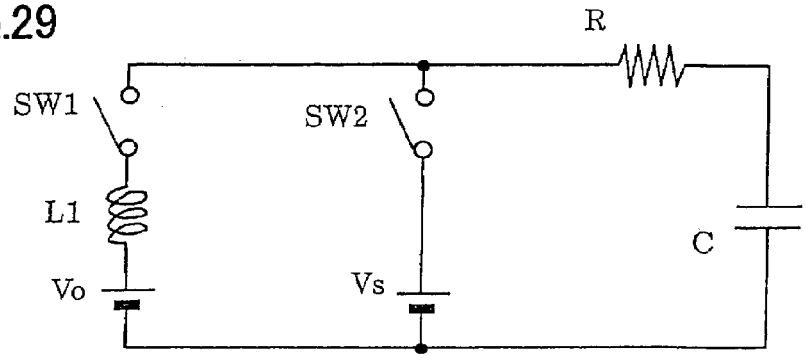
FIG. 29 is an illustrative view of a circuit for forming a conventional offset waveform.
Figure 30:
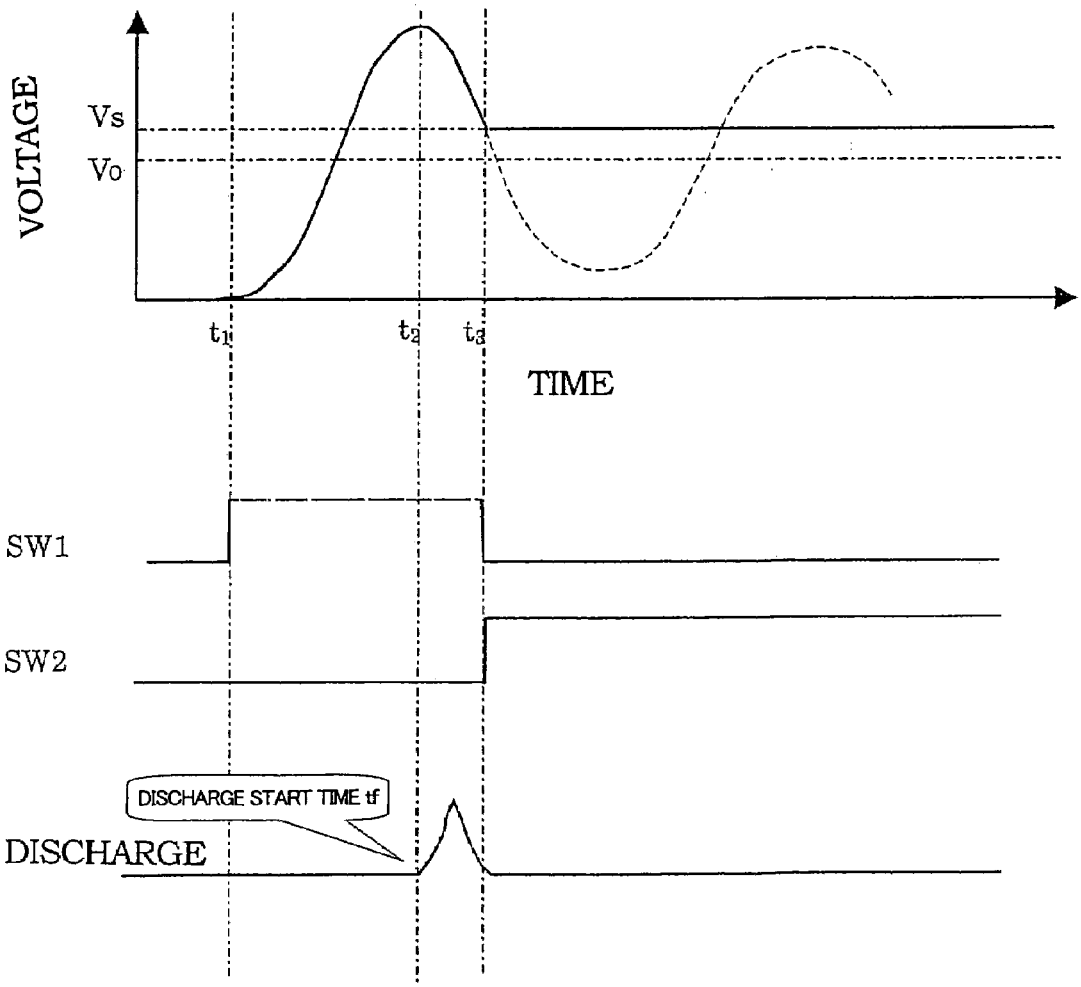
FIG. 30 is a switching timing diagram of the circuit for forming the conventional offset waveform.
Figure 31:
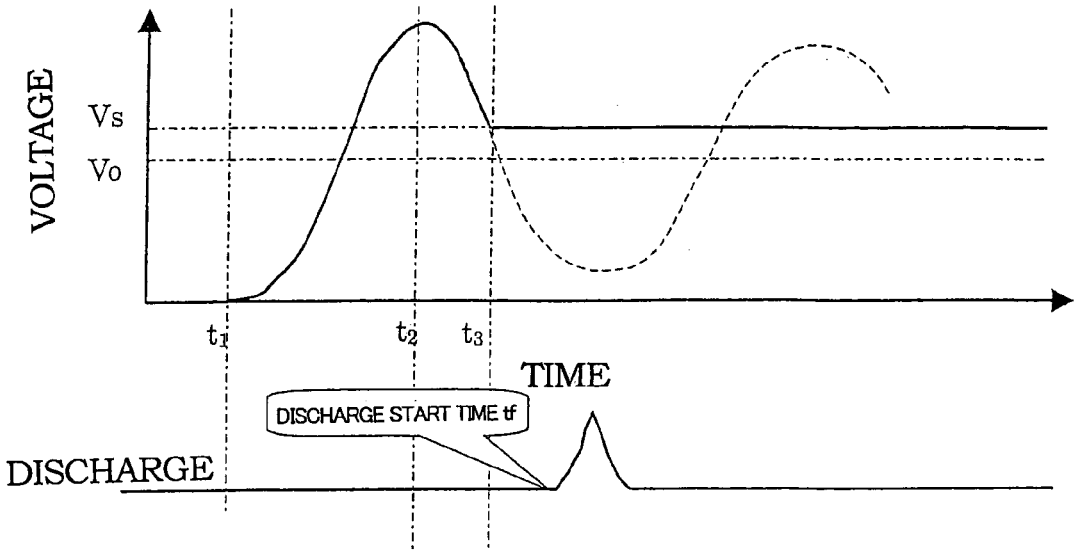
FIG. 31 is a timing chart of an example in which a conventional discharge start time is after the acquisition of the maximum voltage.
Figure 32:
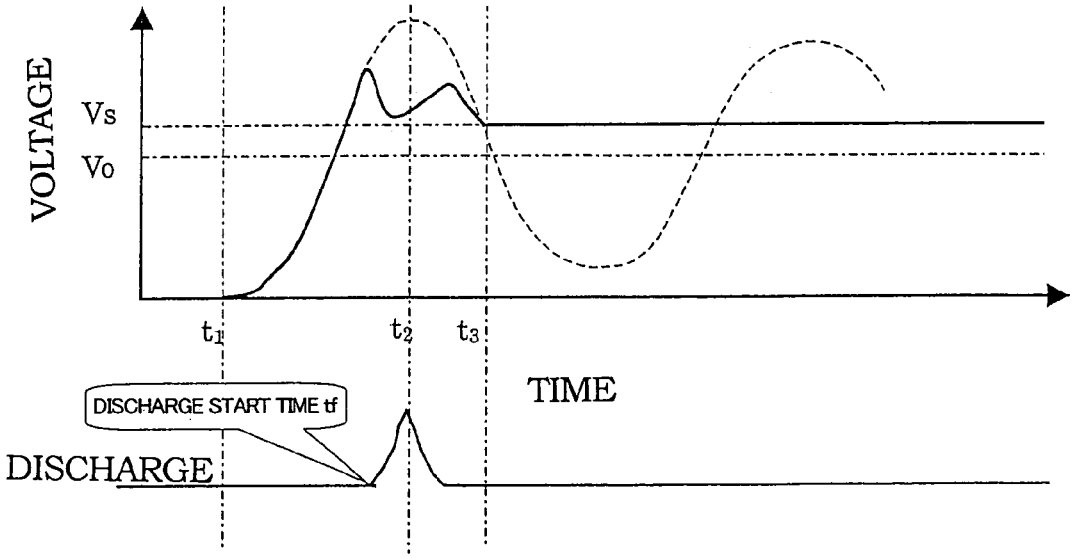
FIG. 32 is a timing diagram of an example in which a conventional discharge start time is before the acquisition of the maximum voltage.

In the first embodiment, a diode D1 is inserted in series with the switch SW1 and the inductor L1 unlike the constitution of the conventional circuit shown in FIG. 29.

As long as the diode D1 is inserted between the source of voltage Vo and a connecting point with the switch SW2, the effect of the diode D1 does not change whether it is located in front or back of the switch SW1 or the inductor L1.

Figure 6:
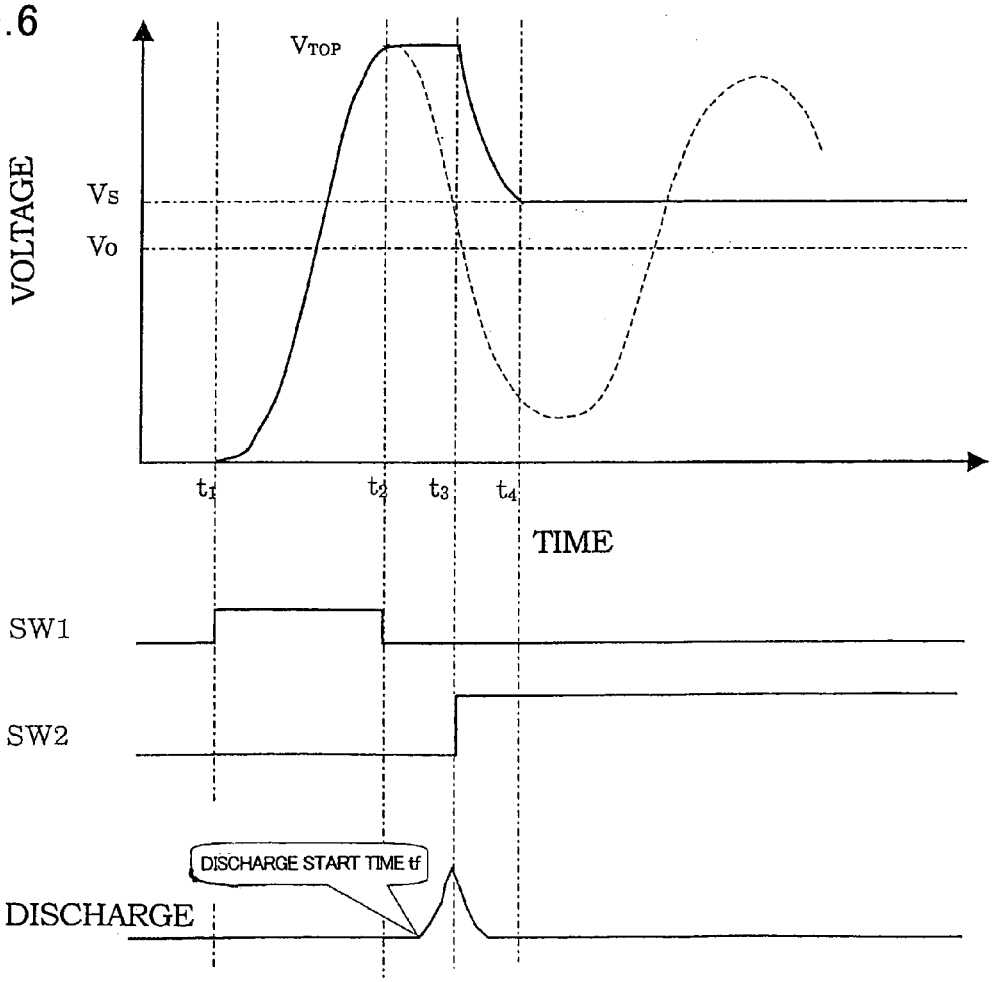
FIG. 6 is a timing diagram of switches SW1 and SW2.

FIG. 6 is a timing diagram of the switches SW1 and SW2.

In the figure, t1 signifies a rise start time of a waveform, t2 signifies a time at which the maximum voltage is reached, t3 is a fall start time from the maximum voltage of the waveform, and t4 is a time at which the voltage becomes Vs.

At time t1, upon switching "ON" of the switch SW1, a waveform rises due to a resonance phenomenon caused by the condenser C, resistance R and inductor L1. At time t2, the maximum voltage $V_{TOP}$ is reached. In the conventional constitution, the voltage starts to decrease through the inductor L1 after time t2. However, in this embodiment, the maximum voltage $V_{TOP}$ is maintained due to the effect of the diode D1. Subsequently at time t3, the switch SW2 is switched "ON" to lower the voltage, and at time t4, the voltage is reduced to Vs.

According to the first embodiment, the sustain period (a period from time t2 to time t3) of the maximum voltage $V_{TOP}$ can be freely adjusted by setting the ON timing of the switch SW2. As described above, the maximum light emission efficiency can be achieved on the condition that the discharge starts while the voltage is at the maximum. By setting the ON timing of the switch SW2 such that the maximum voltage $V_{TOP}$ is sustained until the discharge start time tf, a highly efficient discharge state can stably be achieved.

Figure 7:
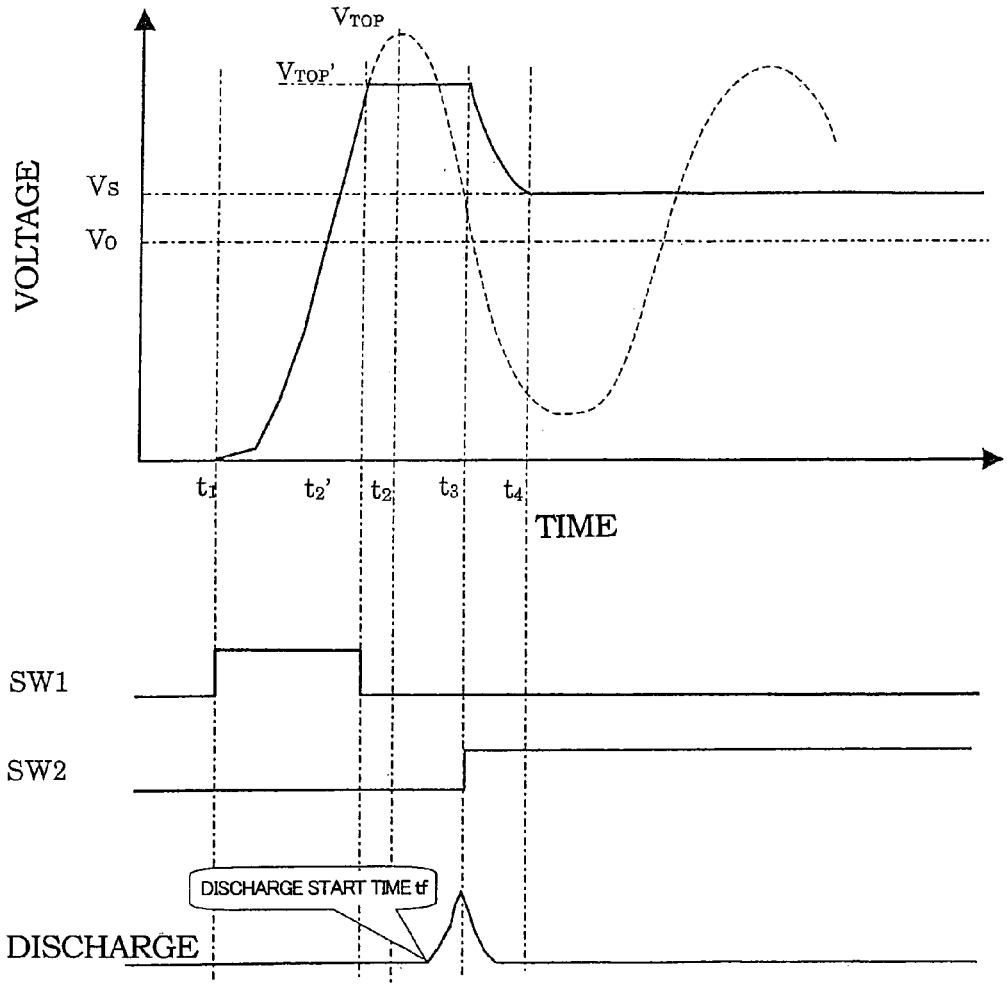
FIG. 7 is another exemplary timing diagram of the switches SW1 and SW2.

FIG. 7 is another exemplary timing diagram of the switches SW1 and SW2.

In this example, when the switch SW1 is switched "ON" at time t1, a waveform rises, and at time t2, the maximum voltage $V_{TOP}$ is almost reached. However, at time t2' which is before time t2, the switch SW1 is switched "OFF". In the conventional constitution, the voltage starts to decrease through the inductor L1 after time t2. However, in this example, the maximum voltage $V_{TOP}'$ is sustained due to the effect of the diode D1. Subsequently at time t3, the switch SW2 is switched "ON" to lower the voltage, and at time t4, the voltage is reduced to Vs.

In this example, the maximum voltage is reached in a shorter period of time than in the previous example, and in terms of adjustment of waveform timing (application timing of an offset waveform) in accordance with discharge timing, the offset waveform application timing can shift in a wider acceptable range. For example, when driving a panel with an early discharge start timing, a higher light emission efficiency can be achieved by adopting the switching timing of the present example than that of the previous example.

Figure 8:
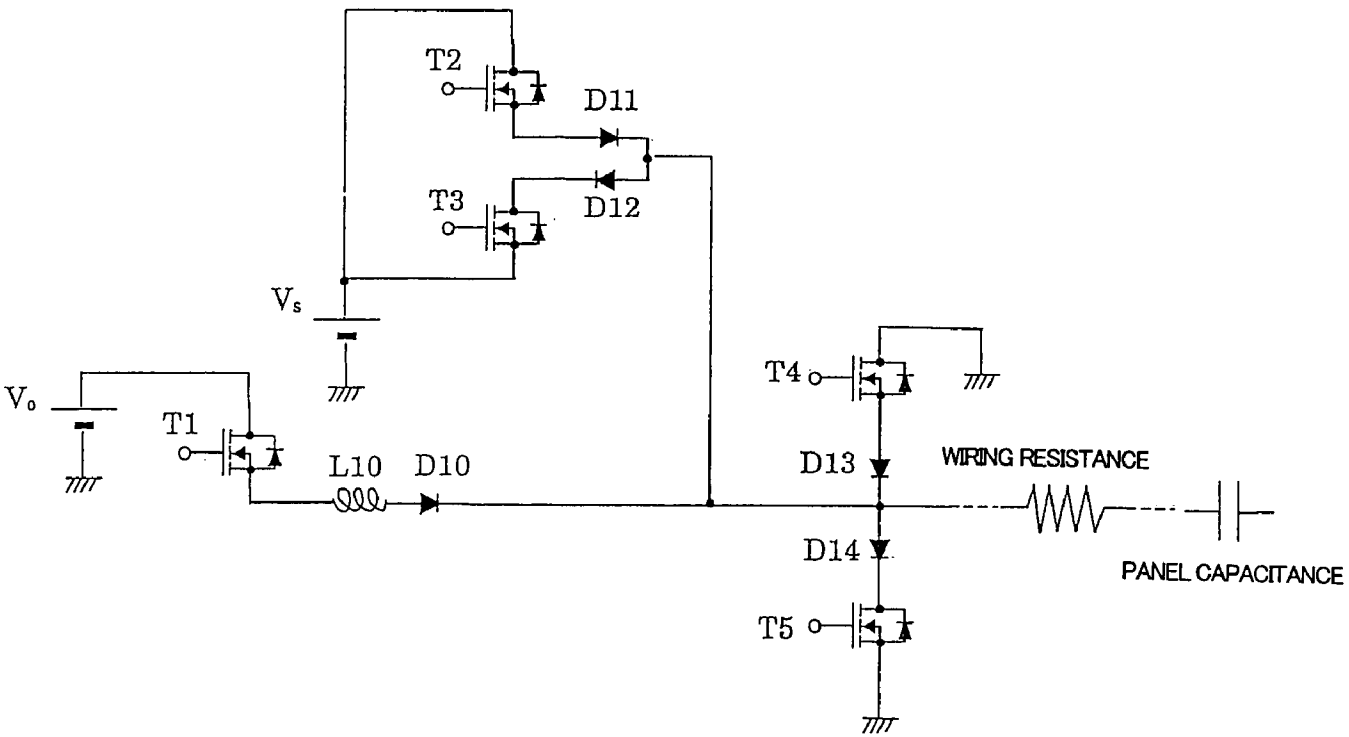
FIG. 8 is an illustrative view of an example of detailed construction of the sustainer circuit of the first embodiment.

FIG. 8 is an illustrative view of an example of detailed construction of the sustainer circuit of the first embodiment.

The sustainer circuit includes a pickup circuit for increasing a voltage from 0 (V) to the maximum voltage $V_{TOP}$ which has a transistor T1, an inductor L10 and a diode D10 connected to a source of voltage Vo; a dropping circuit for reducing the voltage from the maximum voltage $V_{TOP}$ to Vs which has a diode D12 and a transistor T3; a dropping circuit for reducing the voltage from Vs to 0 (V) which has a transistor T5 and a diode D14; a pickup circuit for increasing the voltage to Vs which has a transistor T2 and a diode D11; and a pickup circuit for increasing the voltage to 0 (V) which has a transistor T4 and a diode D13.

At the reduction of the voltage from the maximum voltage $V_{TOP}$ to Vs, the pickup circuit for increasing the voltage to Vs has a role of bringing back up the voltage that has decreased to lower than Vs due to a voltage drop or overshooting at the discharge. Furthermore, at the reduction of the voltage from Vs to 0 (V), the pickup circuit for increasing the voltage to 0 (V) has a role of bringing back up the voltage that has decreased to lower than 0 (V).

Embodiment 2

Figure 9:
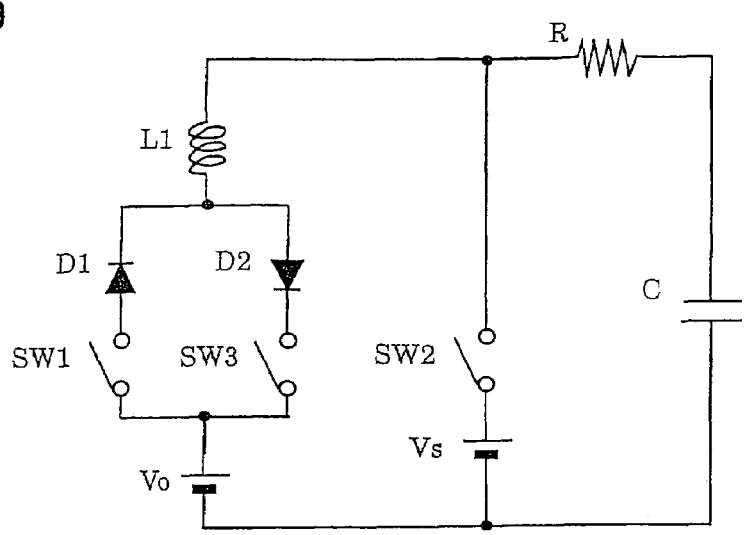
FIG. 9 is an illustrative view of circuit principles of a sustainer circuit according to the second embodiment of the invention.

FIG. 9 is an illustrative view of circuit principles of a sustainer circuit according to the second embodiment of the invention.

In the second embodiment, a switch SW3 and a diode D2 of an opposite polarity to a diode D1 are connected in parallel to a switch SW1 and the diode D1. One side of these components is connected to a source of voltage Vo and the other side is connected to an inductor L1.

Figure 10:
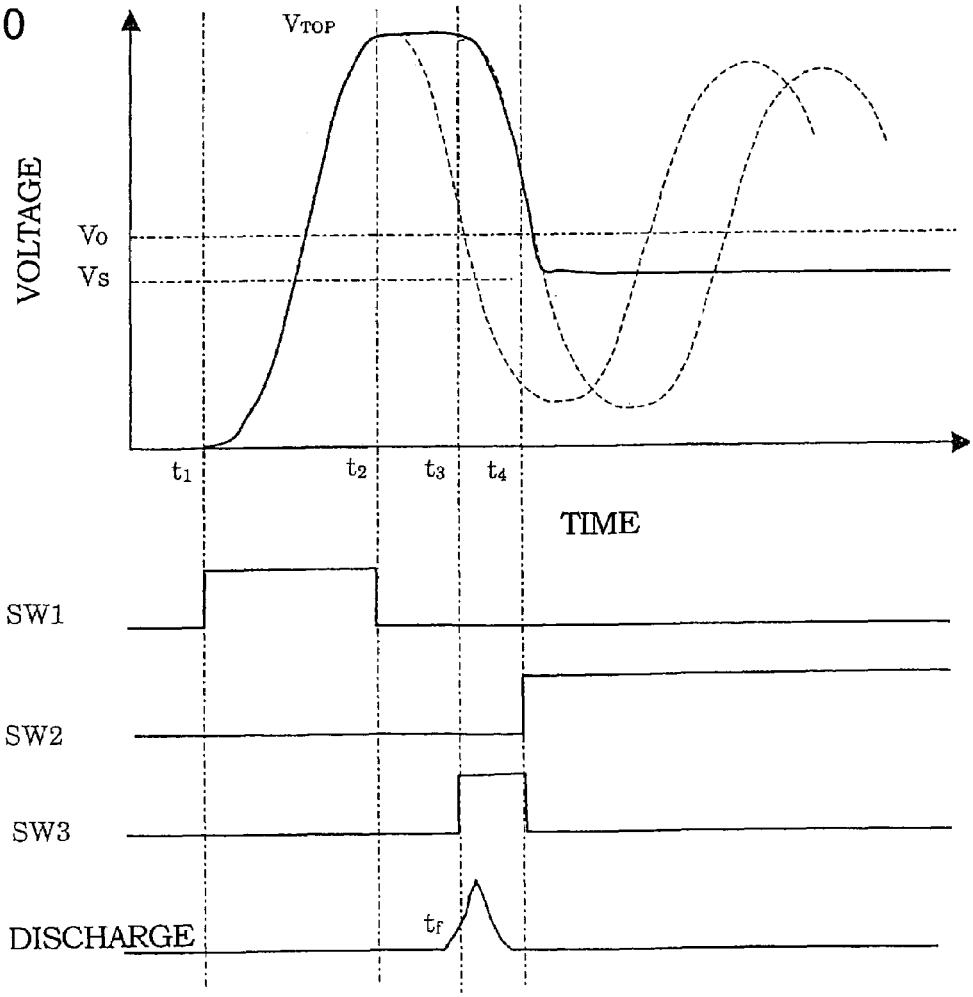
FIG. 10 is a timing diagram of switches SW1, SW2 and SW3.

FIG. 10 is a timing diagram of the switches SW1, SW2 and SW3.

At time t1, a waveform rises by switching "ON" the switch SW1, and at time 2, the maximum voltage $V_{TOP}$ is reached. In this embodiment, the voltage is sustained at the maximum voltage $V_{TOP}$ due to the effect of the diode D1. Subsequently at time t3, the switch SW3 is switched "ON" to lower the voltage. At time t4, the switch SW 3 is switched "OFF" while the switch SW2 is switched "ON" to reduce the voltage to Vs.

According to the second embodiment, the same effects in terms of light emission efficiency and discharge timing as those in the first embodiment can be obtained. Furthermore, in the first embodiment, loss of electric power occurs when reducing the voltage from $V_{TOP}$ to Vs with the switch SW2, whereas in the second embodiment, the amount of ineffective electric power can be reduced since a resonance phenomenon caused by the inductor L1 is utilized.

Figure 11:
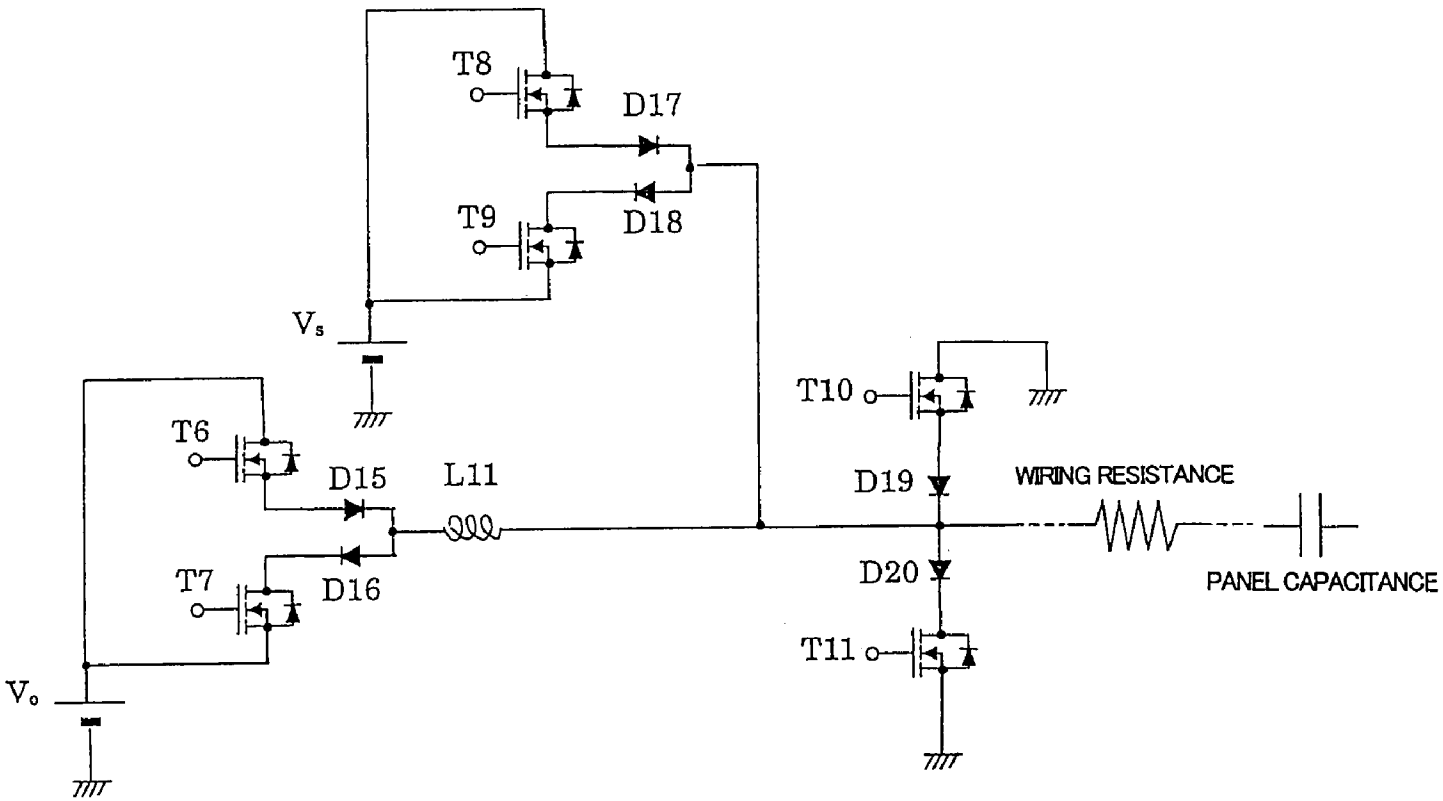
FIG. 11 is an illustrative view of an example of detailed construction of the sustainer circuit of the second embodiment.

FIG. 11 is an illustrative view of an example of detailed construction of the sustainer circuit of the second embodiment.

The sustainer circuit includes a pickup circuit for increasing a voltage from 0 (V) to the maximum voltage $V_{TOP}$ which has a transistor T6, an inductor L11 and a diode D15 connected to a source of voltage Vo; a dropping circuit for reducing the voltage from the maximum voltage $V_{TOP}$ which has a diode D16, a transistor T7 and an inductor L11; a dropping circuit for reducing the voltage to Vs which has a diode D18 and a transistor T9; a dropping circuit for reducing the voltage from Vs to 0 (V) which has a transistor T11 and a diode D20; a pickup circuit for increasing the voltage to Vs which has a transistor T8 and a diode D17; and a pickup circuit for increasing the voltage to 0 (V) which has a transistor T10 and a diode D19.

The pickup circuit for increasing the voltage to Vs and the dropping circuit for reducing the voltage to 0 (V) have the same role as that of the circuits of the first embodiment.

Embodiment 3

Figure 12:
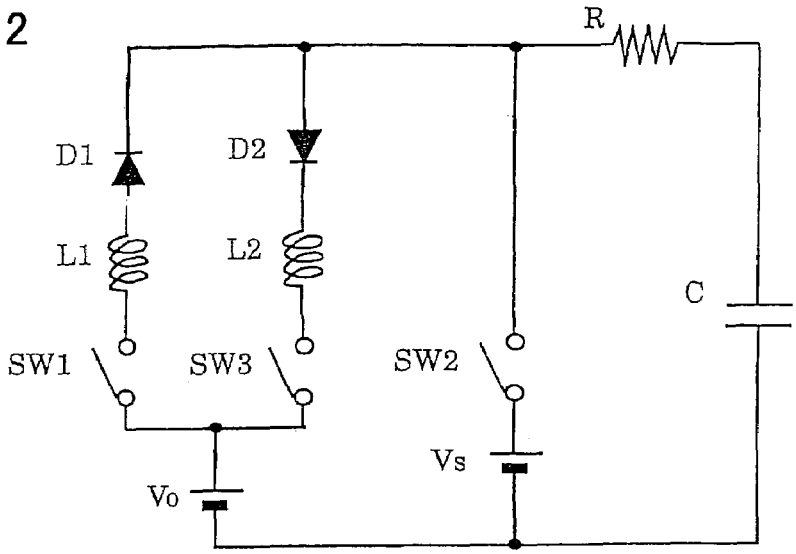
FIG. 12 is an illustrative view of circuit principles of a sustainer circuit according to the third embodiment.

FIG. 12 is an illustrative view of circuit principles of a sustainer circuit according to the third embodiment of the invention.

In the third embodiment, a switch SW3, a diode D2 of an opposite polarity to a diode D1 and an inductor L2 are connected in parallel to a switch SW1, the diode D1 and an inductor L1. One side of these components is connected to a source of voltage Vo and the other side is connected to an electrode line running to a resistance R and a condenser C.

Figure 13:
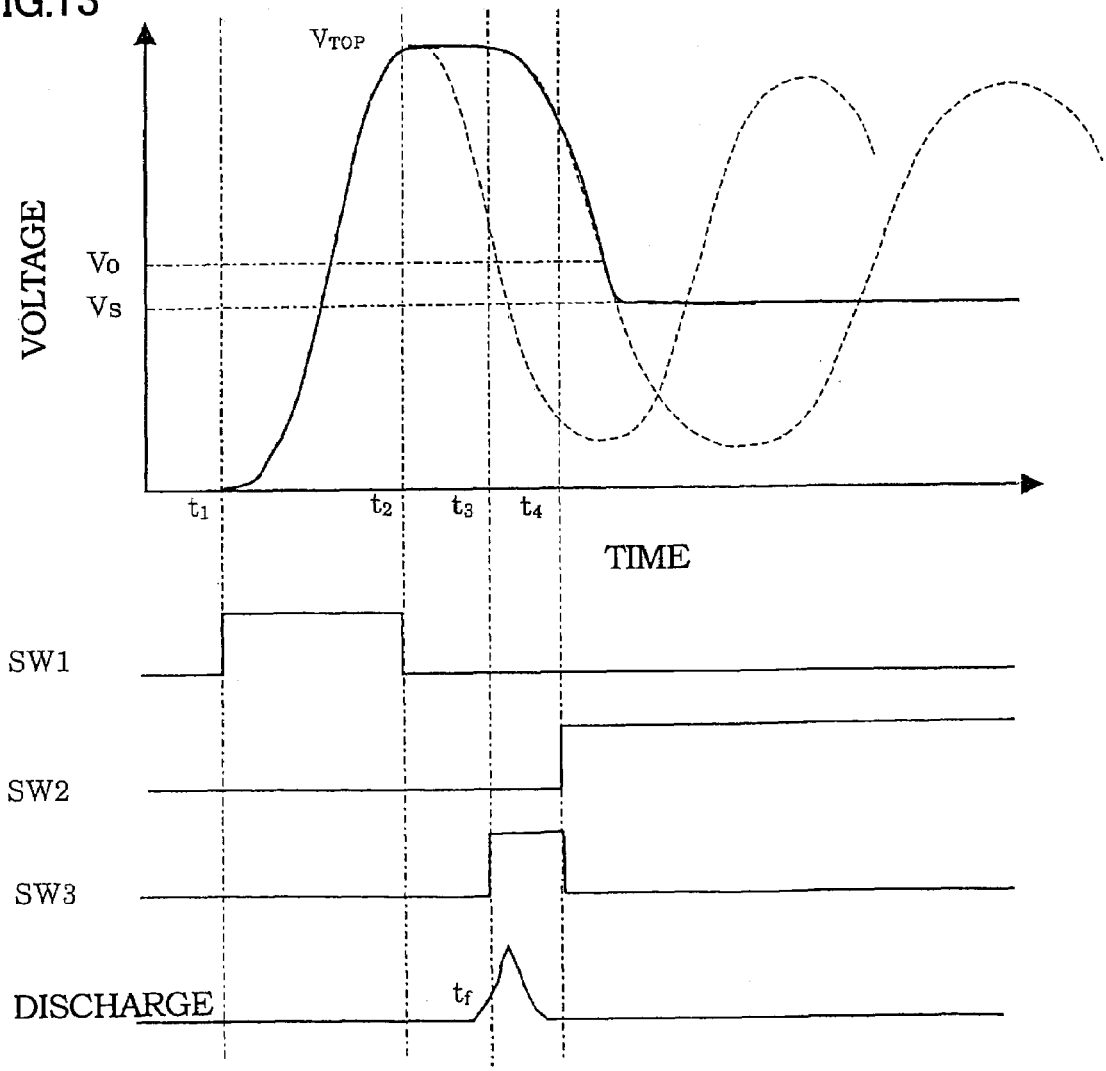
FIG. 13 is a timing diagram of switches SW1 to SW3.

FIG. 13 is a timing diagram of switches SW1 to SW3.

At time t1, a waveform rises by switching "ON" the switch SW1, and at time t2, the maximum voltage $V_{TOP}$ is reached. In this embodiment, the voltage is sustained at the maximum voltage $V_{TOP}$ due to the effect of the diode D1. Subsequently at time t3, the switch SW3 is switched "ON" to lower the voltage. At time t4, the switch SW3 is switched "OFF" while the switch SW2 is switched "ON" to reduce the voltage to Vs.

According to the third embodiment, the same effects in terms of light emission efficiency and discharge timing as those in the first embodiment can be obtained. Furthermore, the amount of ineffective electric power can be reduced since a resonance phenomenon caused by the inductor L2 is utilized for changing the voltage from the maximum voltage $V_{TOP}$ to Vs as in the second embodiment. As compared to the second embodiment, the third embodiment can, by including two types of inductors, freely set the time constants of the waveform rise and fall, and thereby the circuit design conditions can be adjusted to be more efficient.

According to the third embodiment, the diodes D1 and D2 are located nearer to a panel than the inductors L1 and L2 are. When the diodes are located nearer to the power source than the inductors are as in the second embodiment, a problem occurs that a slight amount of reverse current pulled back to the diode flows at time t2, and the flow of reverse current is expanded to large voltage noise through the inductor. In this embodiment, however, such a problem is lessened.

Figure 14:
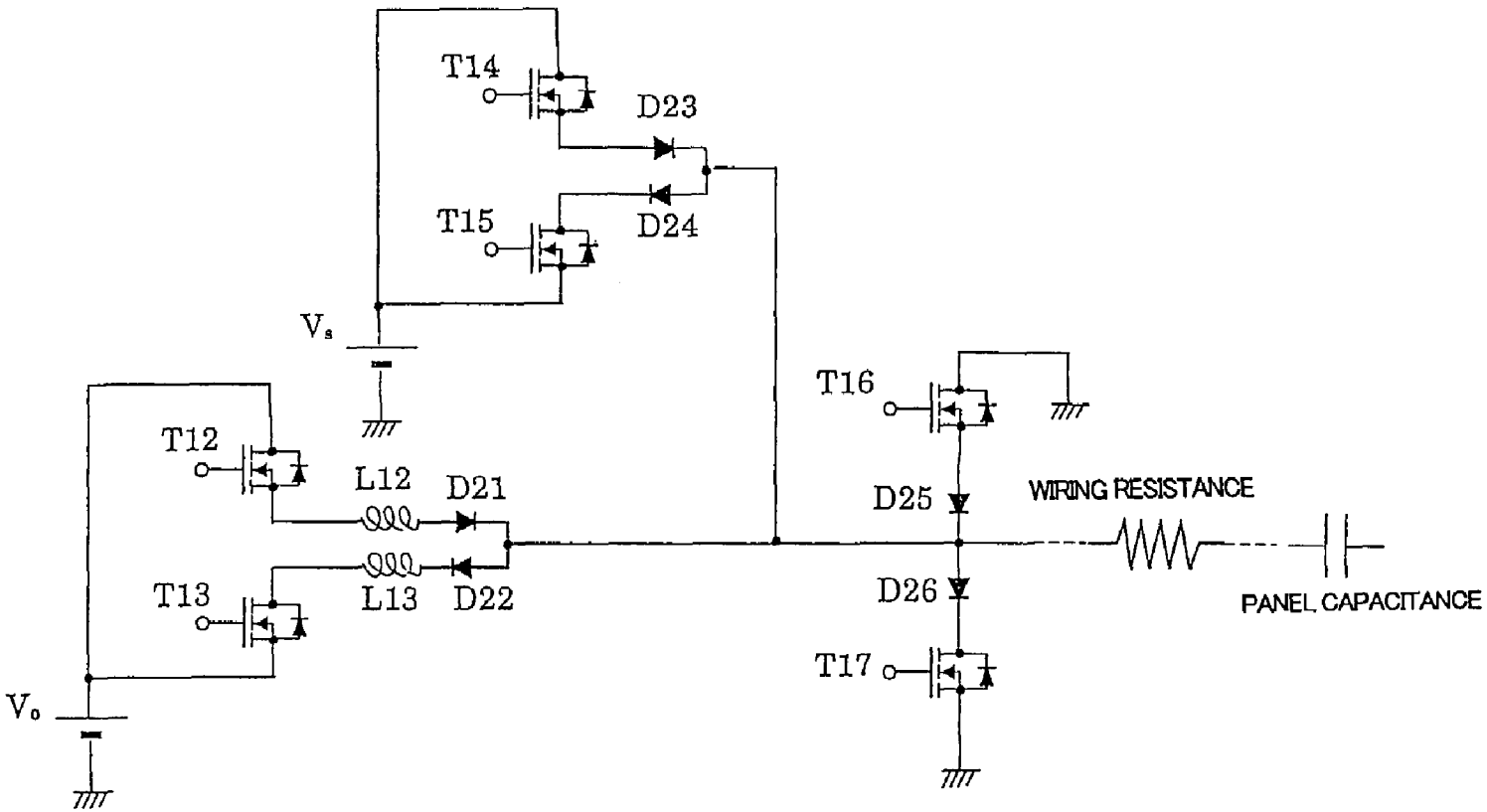
FIG. 14 is an illustrative view of an example of detailed construction of the sustainer circuit of the third embodiment.

FIG. 14 is an illustrative view of an example of detailed construction of the sustainer circuit of the third embodiment.

The sustainer circuit includes a pickup circuit for increasing a voltage from 0 (V) to the maximum voltage $V_{TOP}$ which has a transistor T12, an inductor L12 and a diode D21 connected to a source of voltage Vo; a dropping circuit for reducing the voltage from the maximum voltage $V_{TOP}$ which has a diode D22, a transistor T13 and an inductor L13; a dropping circuit for reducing the voltage to Vs which has a diode D24 and a transistor T15; a dropping circuit for reducing the voltage from Vs to 0 (V) which has a transistor T17 and a diode D26; a pickup circuit for increasing the voltage to Vs which has a transistor T14 and a diode D23; and a pickup circuit for increasing the voltage to 0 (V) which has a transistor T16 and a diode D25.

The pickup circuit for increasing the voltage to Vs and the pickup circuit for increasing the voltage to 0 (V) have the same role as that of the circuits of the first embodiment.

Embodiment 4

Figure 15:
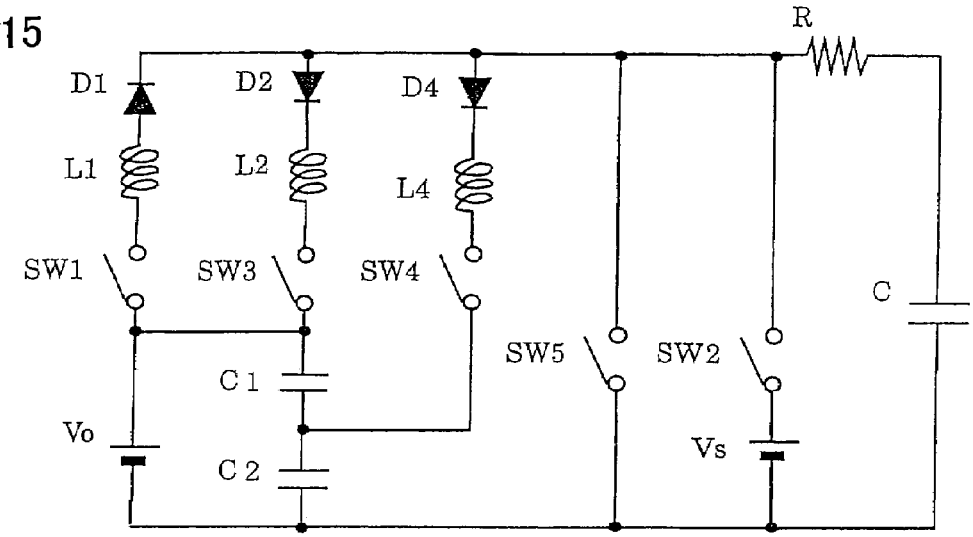
FIG. 15 is an illustrative view of circuit principles of a sustainer circuit according to the fourth embodiment.

FIG. 15 is an illustrative view of circuit principles of a sustainer circuit according to the fourth embodiment of the invention.

In the fourth embodiment, a switch SW3, a diode D2 of an opposite polarity to a diode D1 and an inductor L2 are connected in parallel to a switch SW1, the diode D1 and an inductor L1. One side of these components is connected to a source of voltage Vo and the other side is connected to an electrode line which is lead to a resistance R and a condenser C. Two series-connected condensers C1 and C2 are connected in parallel to a source of voltage Vo, and a midpoint between the condensers C1 and C2 and the electrode line running to the resistance R and the condenser C are connected by a switch SW4, an inductor L4 and a diode D4.

A switch SW 5 is provided between a ground line and the electrode line running to the resistance R and the condenser C.

Figure 16:
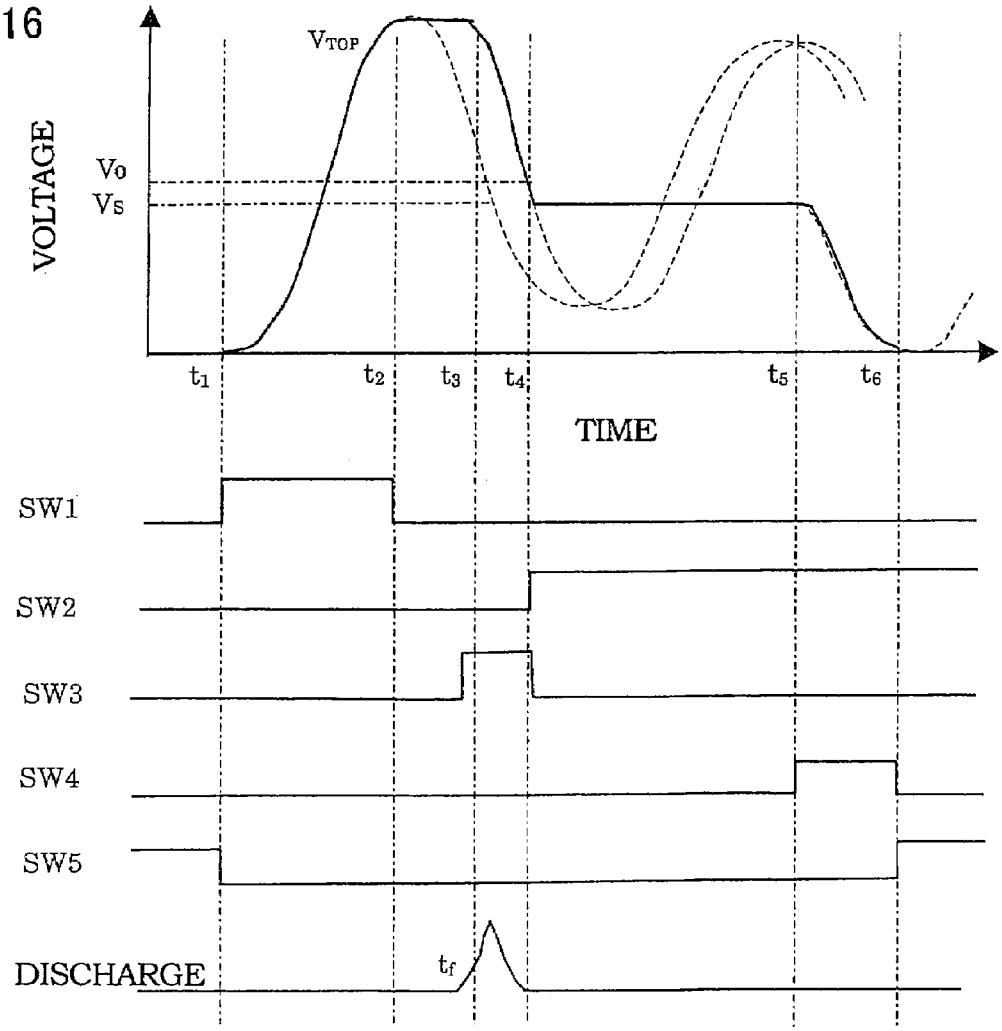
FIG. 16 is a timing diagram of switches SW1 to SW5.

FIG. 16 is a timing diagram of the switches SW1 to SW5.

A waveform rises by switching "OFF" the switch SW5 just before time t1 and switching "ON" the switch SW1 at time t1. At time t2, the maximum voltage $V_{TOP}$ is reached. Subsequently at time t3, the switch SW3 is switched "ON" to lower the voltage. At time t4, the switch SW3 is switched "OFF" while the switch SW2 is switched "ON" to sustain the voltage at Vs. Then, at time t5, the switch SW2 is switched "OFF" while the switch SW4 is switched "ON" to lower the voltage. At time t6, the switch SW4 is switched "OFF" while the switch SW5 is switched "ON" to reduce the voltage to 0 (V).

According to the fourth embodiment, the same effects in terms of light emission efficiency and discharge timing as those in the first embodiment can be obtained. Furthermore, the amount of ineffective electric power can be reduced since a resonance phenomenon caused by the inductor L2 is utilized for changing the voltage from the maximum voltage $V_{TOP}$ to Vs as in the second embodiment. Still more, the amount of ineffective electric power can further be reduced since the resonance phenomenon caused by the inductor L4 is utilized for changing the voltage from Vs to 0 (V).

Figure 17:
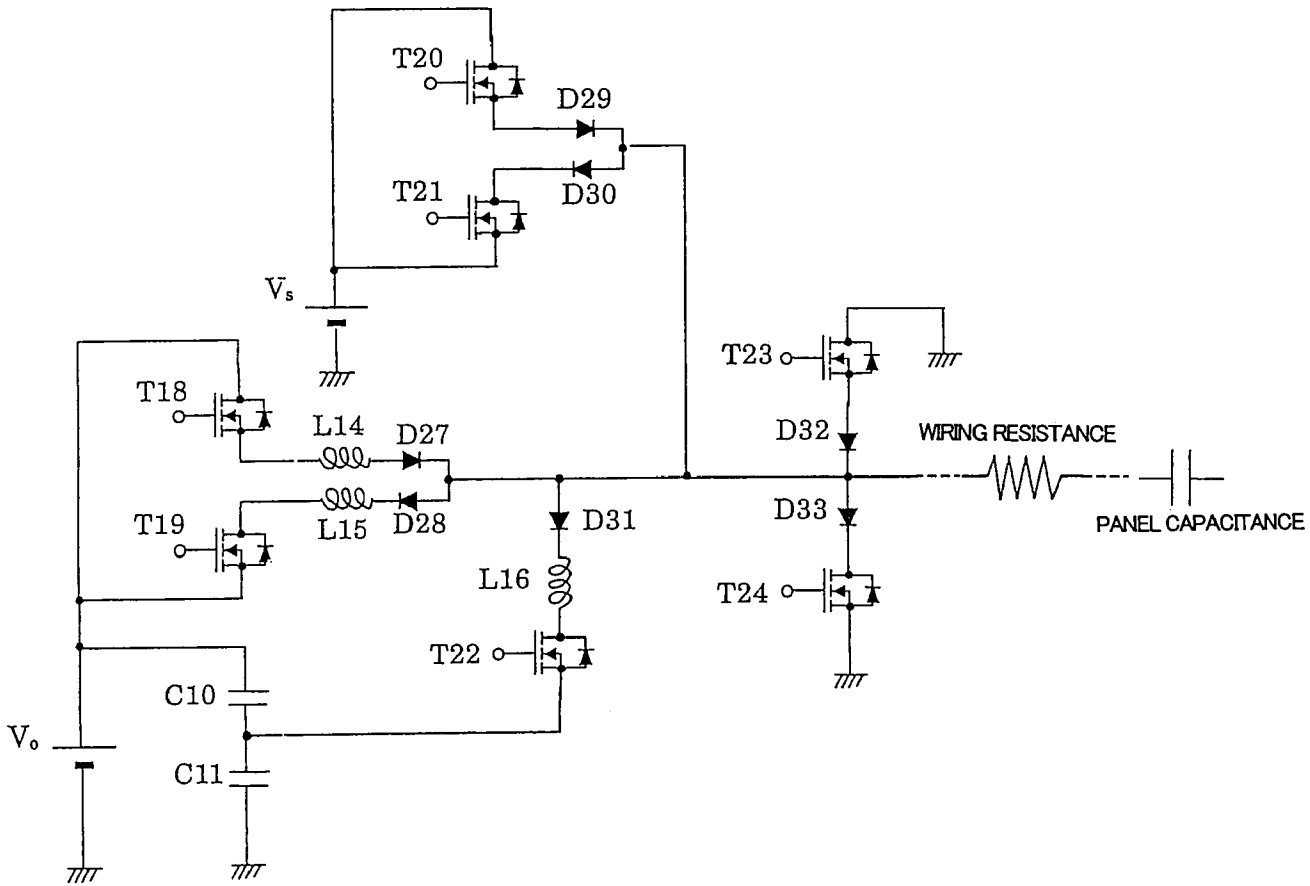
FIG. 17 is an illustrative view of an example of detailed construction of the sustainer circuit of the fourth embodiment.

FIG. 17 is an illustrative view of an example of detailed construction of the sustainer circuit of the fourth embodiment.

The sustainer circuit includes a pickup circuit for increasing a voltage from 0 (V) to the maximum voltage $V_{TOP}$ which has a transistor T18, an inductor L14 and a diode D27 connected to a source of voltage Vo; a dropping circuit for reducing the voltage from the maximum voltage $V_{TOP}$ which has a diode D28, a transistor T19 and an inductor L15; a dropping circuit for reducing the voltage to Vs which has a diode D30 and a transistor T21; a dropping circuit for reducing the voltage from Vs to 0 (V) which has a transistor T22, an inductor L16 and a diode D31 connected to a midpoint between two condensers C10, C11 connected in parallel to sources of voltages 0(V) and $V_0$; a dropping circuit for reducing the voltage from $V_s$ to 0 (V) which has a transistor T24 and a diode D33; a pickup circuit for increasing the voltage to $V_s$ which has a transistor T20 and a diode D29; and a pickup circuit for increasing the voltage to 0 (V) which has a transistor T23 and a diode D32.

The pickup circuit for increasing the voltage to Vs and the pickup circuit for increasing the voltage to 0 (V) have the same role as that of the circuits of the first embodiment.

Embodiment 5

Figure 18:
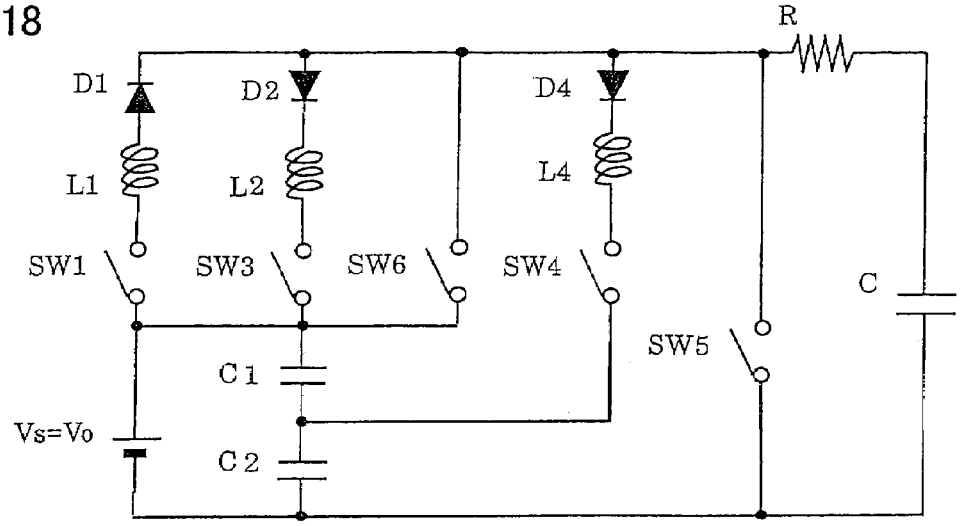
FIG. 18 is an illustrative view of circuit principles of a sustainer circuit according to the fifth embodiment.

FIG. 18 is an illustrative view of circuit principles of a sustainer circuit according to the firth embodiment of the invention.

In the fifth embodiment, a switch SW2 is connected to a circuit having series-connected switch SW3, an inductor L2 and a diode D2 of an opposite polarity to a diode D1 in parallel to a switch SW1, diode D1 and inductor L1. One side of these components is connected to a source of voltage Vo (=Vs) and the other side is connected to an electrode line which is running to a resistance R and a condenser C. Two series-connected condensers C1, C2 are connected in parallel to a source of voltage Vo, and a midpoint between the condensers C1, C2 and an electrode line running to the resistance R and the condenser C are connected by a switch SW4, an inductor L4 and a diode D4. A switch SW5 is provided between a ground line and the electrode line running to the resistance R and the condenser C.

Figure 19:
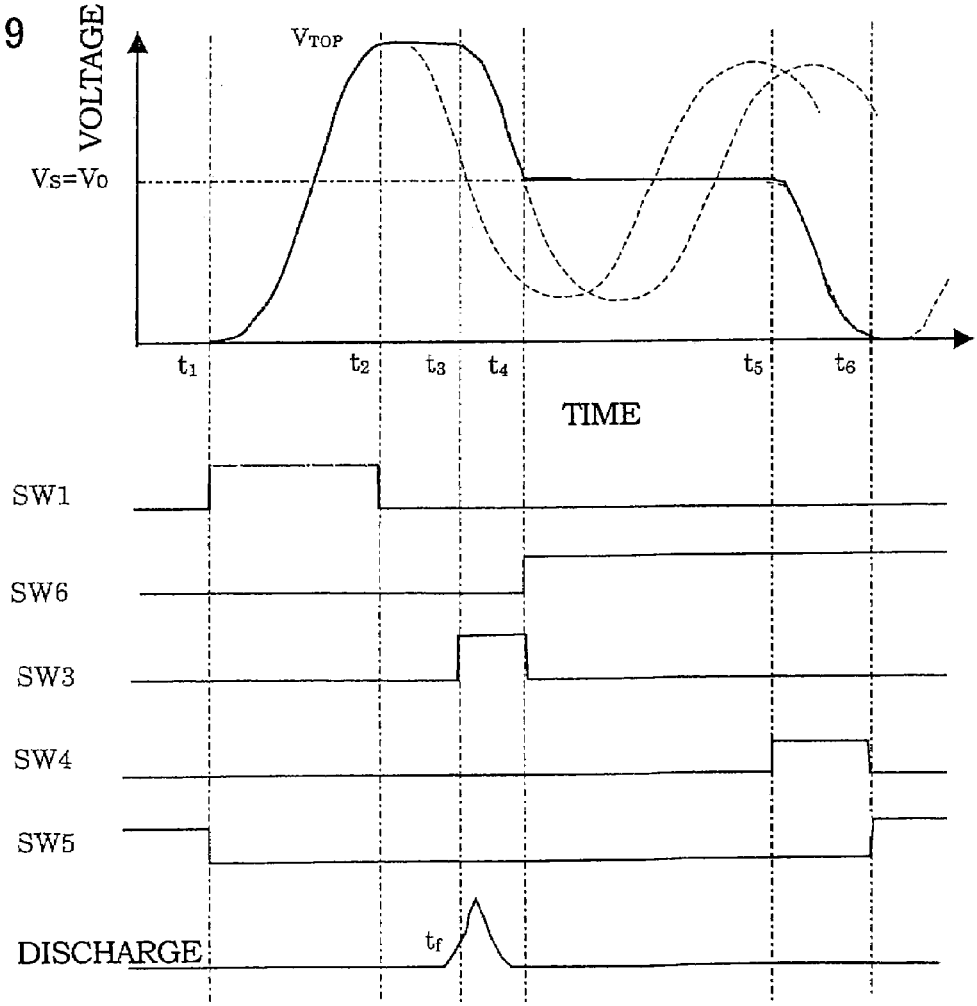
FIG. 19 is a timing diagram of switches SW1 to SW5.

FIG. 19 is a timing diagram of the switches SW1 to SW5.

A waveform rises by switching "OFF" the switch SW5 just before time t1, and switching "ON" the switch SW1 at time t1. At time t2, the maximum voltage $V_{TOP}$ is reached. Subsequently at time t3, the switch SW3 is switched "ON" to lower the voltage. At time t4, the switch SW3 is switched "OFF" while the switch SW6 is switched "ON" to sustain the voltage at Vo (=Vs). Then, at time t5, the switch SW6 is switched "OFF" while the switch SW4 is switched "ON" to lower the voltage. At time t6, the switch SW4 is switched "OFF" while the switch SW5 is switched "ON" to reduce the voltage to 0 (V).

According to the fifth embodiment, the same effects in terms of light emission efficiency and discharge timing as those in the first embodiment can be obtained. Furthermore, the amount of ineffective electric power can be reduced since a resonance phenomenon caused by the inductor L2 is utilized for changing the voltage from the maximum voltage $V_{TOP}$ to Vs as in the second embodiment. Still more, the amount of ineffective electric power can further be reduced since a resonance phenomenon caused by the inductor L4 is utilized for reducing the voltage from Vs to 0 (V). Since the sources of voltages Vs and Vo are set to have the same voltage and they use a common power source, the circuit can be simplified compared to the circuit of the fourth embodiment.

Figure 20:
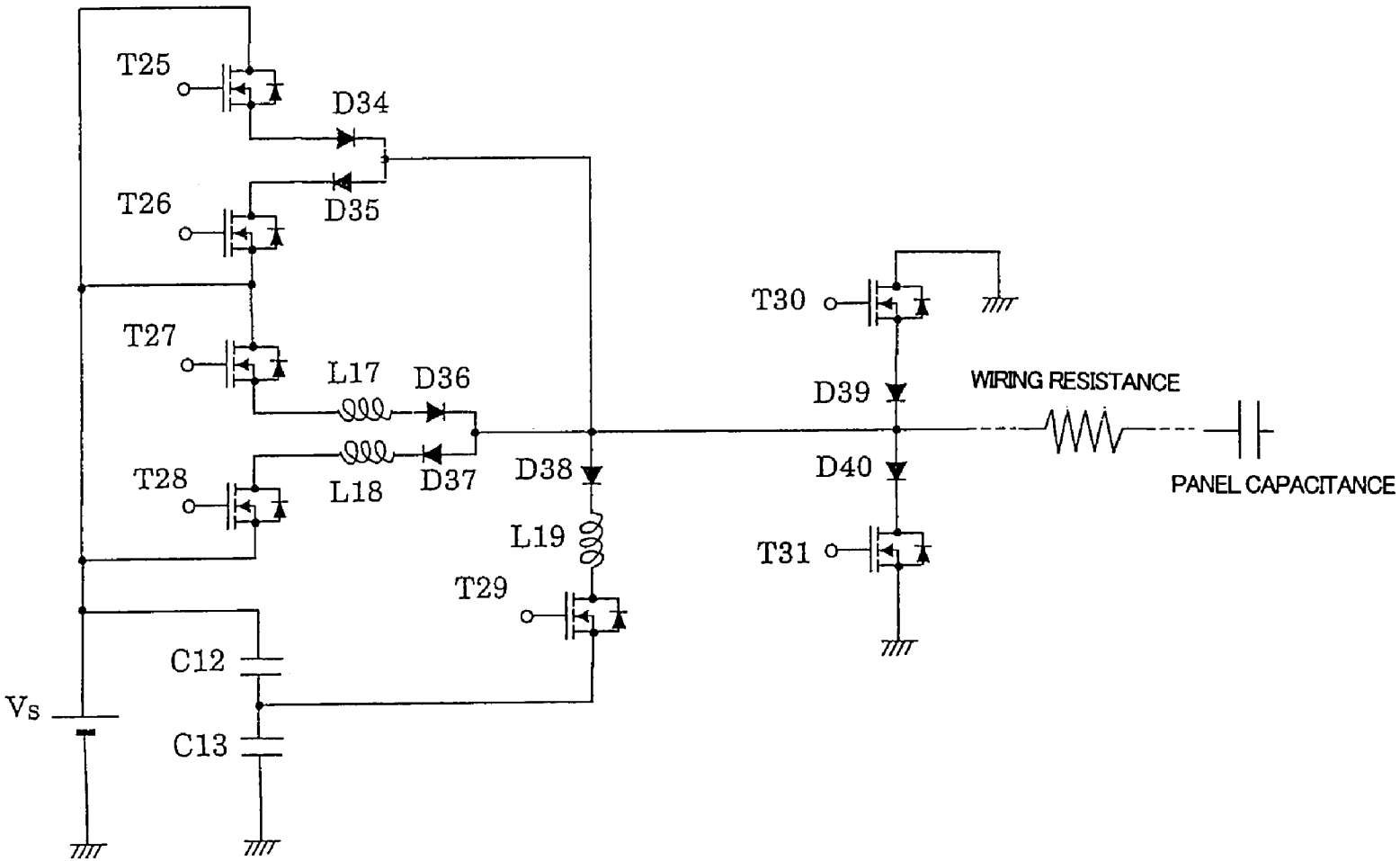
FIG. 20 is an illustrative view of an example of detailed construction of the sustainer circuit of the fifth embodiment.

FIG. 20 is an illustrative view of an example of detailed construction of the sustainer circuit of the fifth embodiment.

The sustainer circuit includes a pickup circuit for increasing a voltage from 0 (V) to the maximum voltage $V_{TOP}$ which has a transistor T27, an inductor L17 and a diode D36 connected to a source of voltage Vs; a dropping circuit for reducing the voltage from the maximum voltage $V_{TOP}$ for has a diode D37, a transistor T28 and an inductor L18; a dropping circuit for reducing the voltage to Vs for has a diode D35 and a transistor T26; a dropping circuit for reducing the voltage from Vs to 0 (V) which has a transistor T29, an inductor L19 and a diode D38 connected to a middle point between two series-connected condensers C12 and C13 connected in parallel to the source of voltage Vs; a dropping circuit for reducing the voltage from Vs to 0 (V) which has a transistor T31 and a diode D40; a pickup circuit for increasing the voltage to Vs which has a transistor T25 and a diode D34; and a pickup circuit for increasing the voltage to 0 (V) which has a transistor T30 and a diode D39.

The dropping circuit for reducing the voltage to Vs and the pickup circuit for increasing the voltage to 0 (V) have the same role as that of the circuits of the first embodiment.

Embodiment 6

Figure 21:
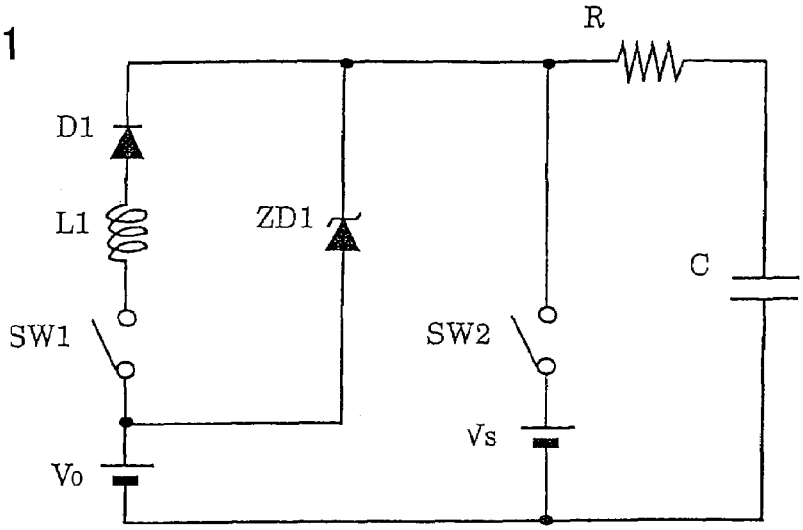
FIG. 21 is an illustrative view of circuit principles of a sustainer circuit according to the sixth embodiment.

FIG. 21 is an illustrative view of circuit principles of a sustainer circuit according to the sixth embodiment.

In the sixth embodiment, a Zener diode ZD1 is connected in parallel to a switch SW1, a diode D1 and an inductor L1. One side of these components is connected to a source of voltage Vo and the other side is connected to an electrode line running to a resistance R and a condenser C. A switch SW2 and a source of voltage Vs are provided between a ground line and the electrode line running to the resistance R and the condenser C.

Figure 22:
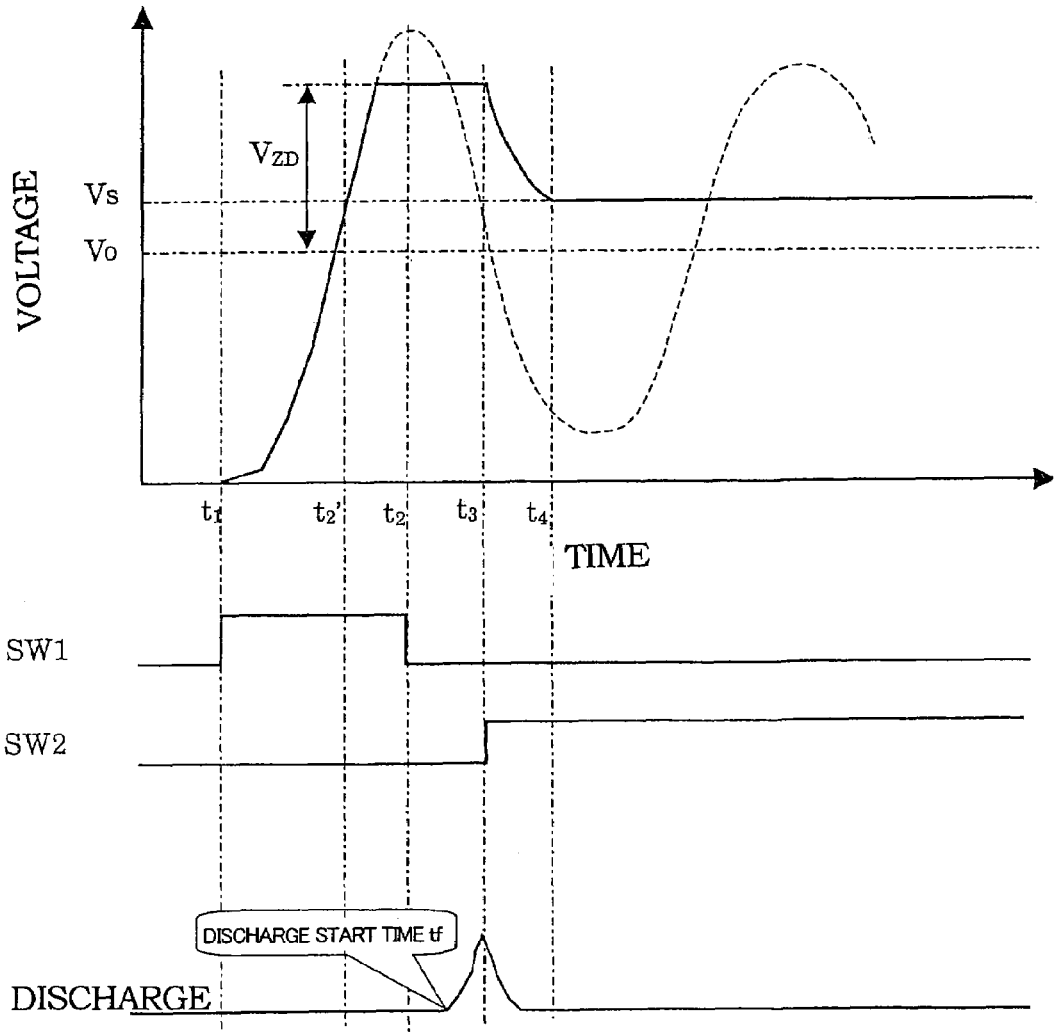
FIG. 22 is a timing diagram of switches SW1 and SW2.

FIG. 22 is a timing diagram of the switches SW1 and SW2.

At time t1, a waveform rises by switching "ON" the switch SW1, and at time t2, the maximum voltage $V_{TOP}$ is almost reached. However, when the voltage exceeds a breakdown voltage Vzd of the Zener diode ZD1 at time t2' which is before time t2, the voltage does not increase any further and is maintained at a predetermined voltage. Subsequently, the switch SW1 is switched "OFF" and the switch SW2 is switched "ON" to reduce the voltage to Vs.

According to the sixth embodiment, the maximum voltage can be reached in a shorter period of time than in the first embodiment, and in terms of adjustment of waveform timing (application timing of an offset waveform) in accordance with discharge timing, the offset waveform application timing can shift in a wider acceptable range. In the modified example of switching timing according to the first embodiment, adjustment of the ultimate voltage is difficult since it changes by the switching timing. According to the sixth embodiment, however, the ultimate voltage can be freely designed by the use of the Zener diode.

Figure 23:
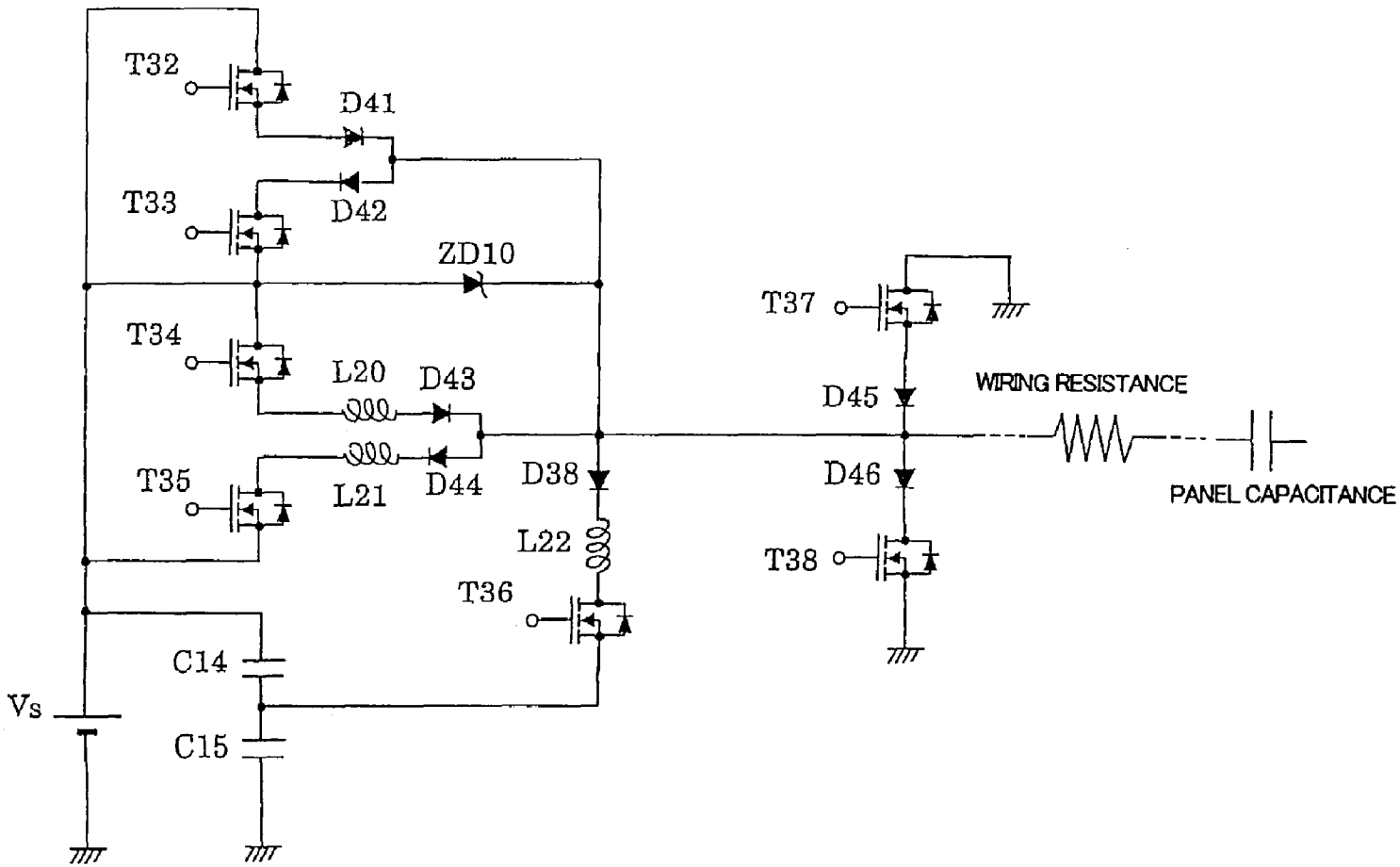
FIG. 23 is an illustrative view of an example of detailed construction of the sustainer circuit of the sixth embodiment.

FIG. 23 is an illustrative view of an example of detailed construction of the sustainer circuit of the sixth embodiment.

The sustainer circuit includes: a pickup circuit for increasing a voltage from 0 (V) to the maximum voltage $V_{TOP}$ which has a transistor T34, an inductor L20 and a diode D43 connected to a source of voltage Vs; a dropping circuit for reducing the voltage from the maximum voltage $V_{TOP}$ which has a diode D44, a transistor T35 and an inductor L21; a dropping circuit for reducing the voltage to Vs which has a diode D42 and a transistor T33; a dropping circuit for reducing the voltage from Vs to 0 (V) which has a transistor T36, an inductor L22 and a diode D38 connected to a middle point between two series-connected condensers C14, C15 connected in parallel to a source of voltage Vs; a dropping circuit for reducing the voltage from Vs to 0 (V) which has a transistor T38 and a diode D46; a pickup circuit for increasing the voltage to Vs which has a transistor T32 and a diode D41; a pickup circuit for increasing the voltage to 0 (V) which has a transistor T37 and a diode D45; and a Zener diode ZD10 connected between the source of voltage Vs and the output.

The pickup circuit for increasing the voltage to Vs and the pickup circuit for increasing the voltage to 0 (V) have the same role as that of the circuits of the first embodiment.

Embodiment 7

Figure 24:
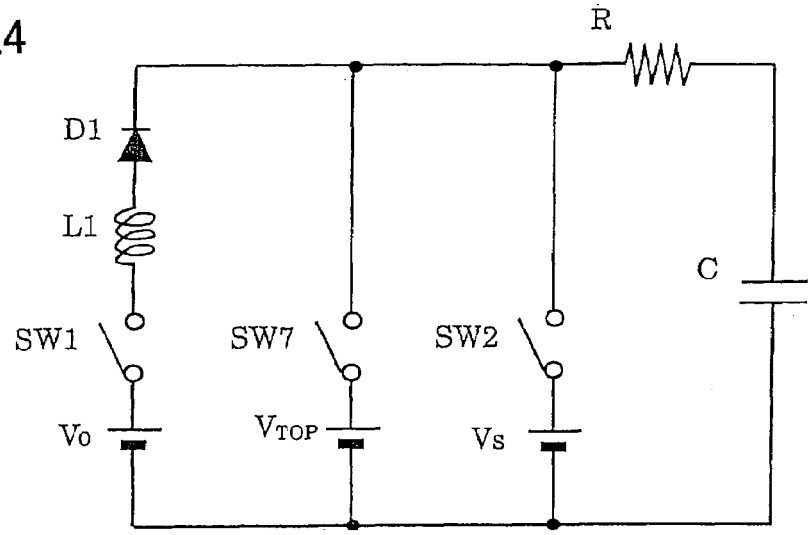
FIG. 24 is an illustrative view of circuit principles of a sustainer circuit according to the seventh embodiment.

FIG. 24 is an illustrative view of circuit principles of a sustainer circuit according to the seventh embodiment.

In the seventh embodiment, a switch SW1, a diode D1 and an inductor L1 are connected in series. One side of these components is connected to a source of voltage Vo and the other side is connected to an electrode line running to a resistance R and a condenser C. A circuit having a switch SW7 and a source of voltage $V_{TOP}$ connected in series and a circuit having a switch SW2 and a source of voltage Vs connected in series are provided between a ground line and the electrode line running to the resistance R and the condenser C.

Figure 25:
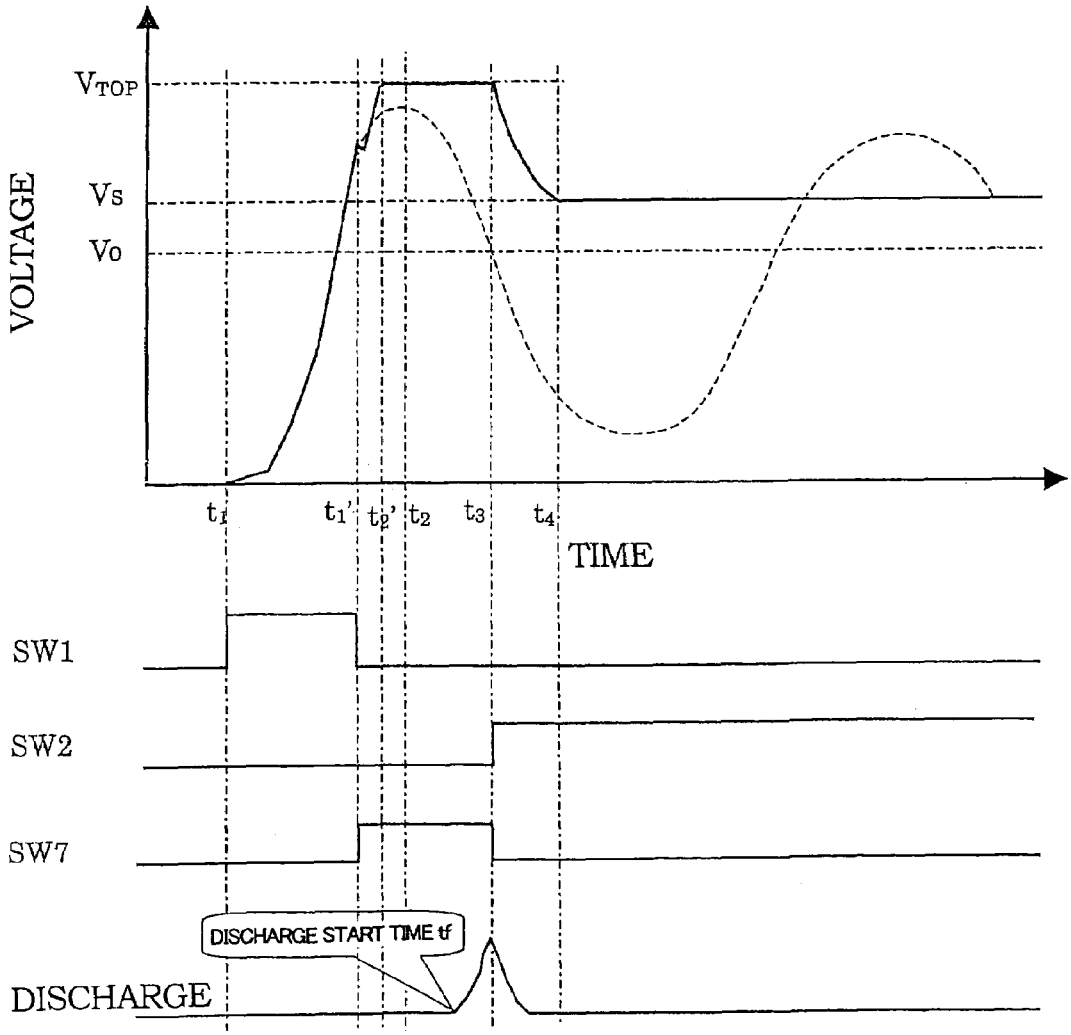
FIG. 25 is a timing diagram of switches SW1, SW2 and SW7.

FIG. 25 is a timing diagram of the switches SW1, SW2 and SW7.

At time t1, a waveform rises by switching "ON" the switch SW1 and at time t2, the maximum voltage $V_{TOP}$ is almost reached. However, when the switch SW7 is switched "ON" at time t1' before time t2, the voltage reaches $V_{TOP}$ at time t2' before time t2. Subsequently, the switches SW1 and SW7 are switched "OFF" and the switch SW2 is switched "ON" to reduce the voltage to Vs.

According to the seventh embodiment, the maximum voltage can be reached in a shorter period of time than in the first embodiment, and in terms of adjustment of waveform timing (application timing of an offset waveform) in accordance with discharge timing, the offset waveform application timing can shift in a wider acceptable range. In the sixth embodiment, there is only a limited choice of breakdown voltages since only a few types of Zener diode are commercially available. According to the seventh embodiment, however, the breakdown voltage can be freely designed.

Figure 26:
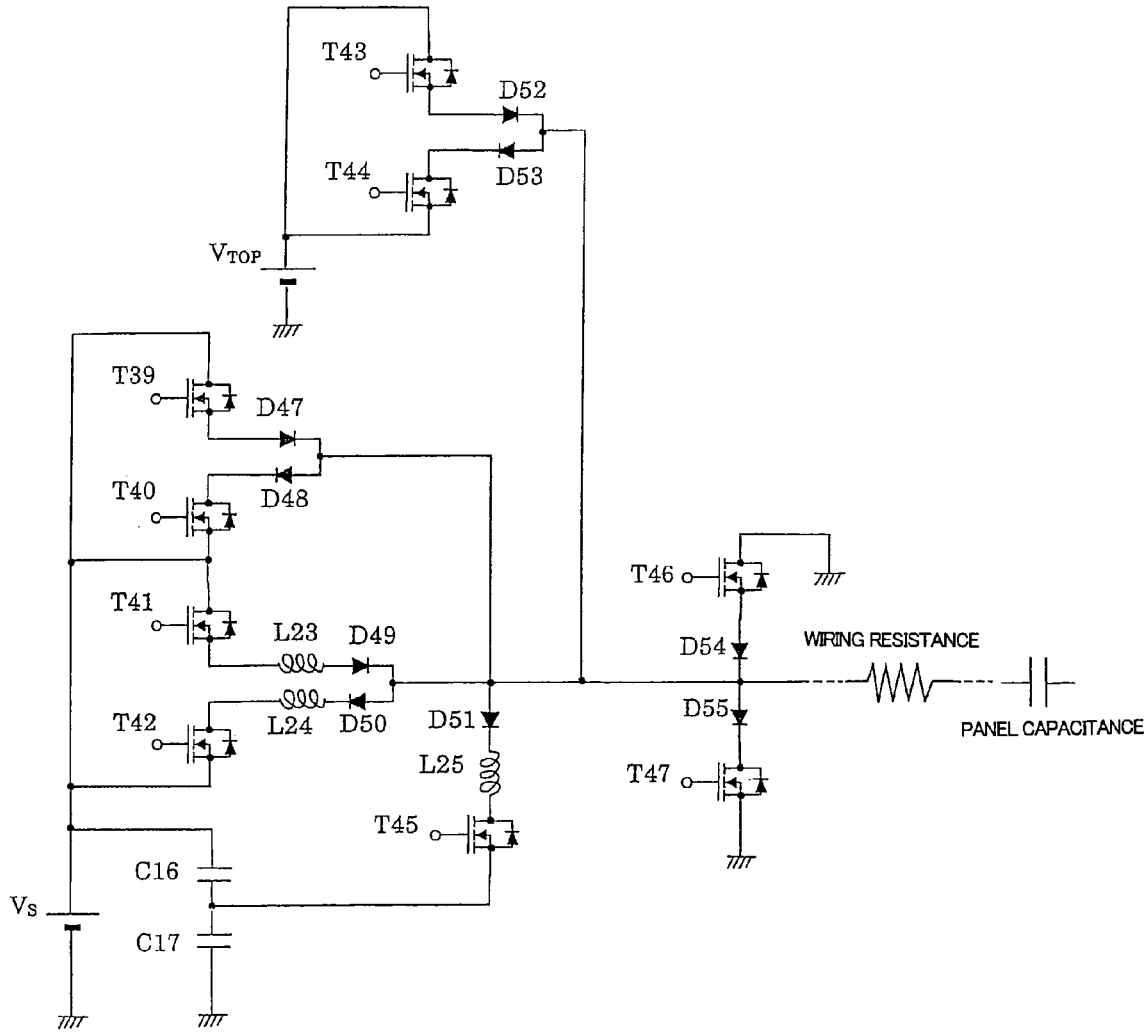
FIG. 26 is an illustrative view of an example of detailed construction of the sustainer circuit of the seventh embodiment.
Figure 27:
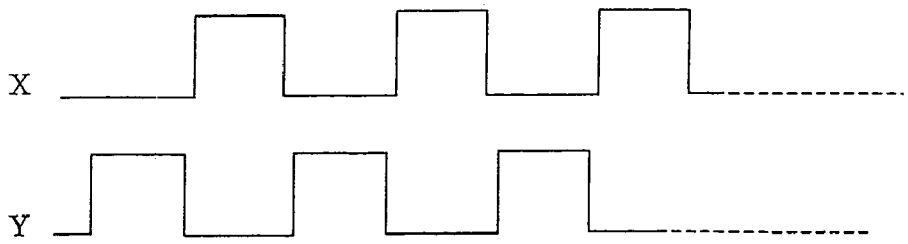
FIG. 27 is a waveform chart of a voltage applied at a conventional sustain discharge.
Figure 28:
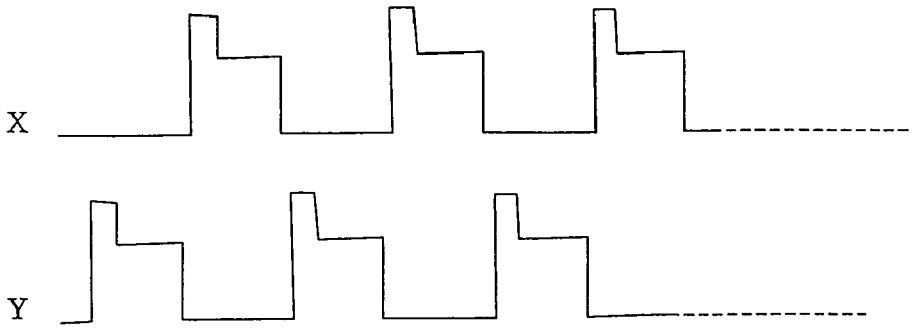
FIG. 28 is a chart of conventional offset waveforms.

FIG. 26 is an illustrative view of an example of detailed construction of the sustainer circuit of the seventh embodiment.

The sustainer circuit includes: a pickup circuit for increasing a voltage from 0 (V) to the maximum voltage $V_{TOP}$ which has a transistor T41, an inductor L23 and a diode D49 connected to a source of voltage Vs; a pickup circuit for increasing the voltage from 0 (V) to the maximum voltage $V_{TOP}$ which has a transistor T43 and a diode D52; a dropping circuit for reducing the voltage from the maximum voltage $V_{TOP}$ which has a diode D50, a transistor T42 and an inductor L24; a dropping circuit for reducing the voltage to Vs which has a diode D48 and a transistor T40; a dropping circuit for reducing the voltage from Vs to 0 (V) which has a transistor T45, an inductor L25 and a diode D51 connected to a middle point between two condensers C16, C17 connected in parallel to a source of voltage Vs; a dropping circuit for reducing the voltage from Vs to 0 (V) which has a transistor T47 and a diode D55; a pickup circuit for increasing the voltage to Vs which has a transistor T39 and a diode D47; a pickup circuit for increasing the voltage to 0 (V) which has a transistor T46 and a diode D54; and a dropping circuit for reducing the voltage to the maximum voltage $V_{TOP}$ which has a transistor T44 and a diode D53.

The pickup circuit for increasing the voltage to Vs and the pickup circuit for increasing the voltage to 0 (V) have the same role as that of the circuits of the first embodiment. Furthermore, at the increase of the voltage from 0 (V) to the maximum voltage $V_{TOP}$, the dropping circuit for reducing the voltage to the maximum voltage $V_{TOP}$ has a role of bringing back down the voltage that has exceeded the maximum voltage $V_{TOP}$ due to overshooting.

Examples of the applied voltages in the aforementioned first to seventh embodiments include: Vs=180 (V), Vo=200 (V) and $V_{TOP}$=400 (V).

By using the driving circuits described hereinabove, a time for sustaining the maximum voltage can be freely adjusted, whereby a discharge can be started while the voltage is at the maximum. This allows for stable formation of a highly efficient discharge state.

The invention claimed is:

1. A driving circuit for a plasma display panel including a plurality of cells each having a pair of display electrodes covered with a dielectric layer, the driving circuit comprising:

a scan circuit for selecting a cell to be lit; and a sustain voltage applying circuit for applying a sustain voltage between the display electrodes of the selected cell so that sustain discharges are generated between the display electrodes for the number of times corresponding to a light intensity, the sustain voltage applying circuit including a sustain pulse generating circuit for generating a sustain pulse of a predetermined waveform and an offset pulse generating circuit for generating an offset pulse higher in peak value than the sustain pulse, the sustain pulse generating circuit and the offset pulse generating circuit being connected in parallel, wherein the offset pulse generating circuit includes a source of a first voltage for applying a offset voltage, a first switching circuit for applying the first voltage between the display electrodes, an inductance component of generating a resonance voltage for applying the offset voltage, and a forward diode for permitting a current supplied to the display electrodes to flow forward so that the resonance voltage is maintained at a higher voltage level than a voltage level of the sustain voltage for a predetermined period of time, and the sustain pulse generating circuit includes a source of a second voltage for applying a sustain voltage and a second switching circuit for applying the second voltage between the display electrodes.

2. The driving circuit of claim 1, wherein, when the resonance voltage level reaches a given voltage level higher than the voltage level of the sustain voltage and lower than a maximum voltage level of the resonance voltage, the first switching circuit is switched off, and after a predetermined period of time, the second switching circuit is switched on.

3. The driving circuit of claim 1, wherein the offset pulse generating circuit further includes a reverse diode and a third switching circuit, the reverse diode making a current supplied to the display electrodes to flow in a reverse direction so that a voltage level of the resonance voltage is lowered to the voltage level of the sustain voltage, the third switching circuit guiding a current to the reverse diode, the reverse diode and the third switching circuit being connected in parallel to a series circuit having the first switching circuit and the forward diode.

4. The driving circuit of claim 1, wherein the offset pulse generating circuit further includes a reverse diode, a decay inductance component and a third switching circuit, the reverse diode making a current supplied to the display electrodes to flow in a reverse direction so that a voltage level of the resonance voltage is lowered to the voltage level of the sustain voltage, the decay inductance component lowering the voltage level of the resonance voltage by resonance, the third switching circuit guiding a current to the reverse diode and the decay inductance component, the reverse diode, the decay inductance component and the third switching circuit being connected in parallel to a series circuit having the first switching circuit, the inductance component and the forward diode.

5. The driving circuit of claim 4, further comprising a fifth switching circuit for switching on or off a short circuit which maintains a voltage applied to the display electrodes at zero, the fifth switching circuit being connected in parallel to a series circuit having the second voltage source and the second switching circuit, wherein the offset pulse generating circuit further includes two condensers connected in series via a middle point and a series circuit for connecting the middle point and the display electrodes, the two series-connected condensers being connected in parallel to the first voltage source, the series circuit connecting the middle point and the display electrodes including a zero level reverse diode for lowering the voltage level of the sustain voltage to zero by making a current supplied to the display electrodes to flow in a reverse direction, a zero-level decay inductance component for lowering the voltage level of the sustain voltage by resonance, a fourth switching circuit for guiding a current to the zero-level reverse diode and the zero-level decay inductance component, the two series-connected condensers being respectively set to have such a capacity that a voltage level of the middle point between the two series-connected condensers is almost equal to a voltage level in the middle of voltage levels of the second and first voltages.

6. The driving circuit of claim 5, wherein the first and second voltage sources are constituted of a common power source.

7. The driving circuit of claim 1, wherein the offset pulse generating circuit further includes a Zener diode for maintaining the resonance voltage at a predetermined voltage level higher than the voltage level of the sustain voltage and lower than a maximum voltage level of the resonance voltage when the resonance voltage reaches the predetermined voltage level, the Zener diode being connected to a series circuit having the first switching circuit, the inductance component and the forward diode.

8. The driving circuit of claim 1, wherein the offset pulse generating circuit further includes a third voltage source for outputting a third voltage of higher voltage level than a maximum voltage level of the resonance voltage and a third switching circuit for applying the third voltage between the display electrodes, the third voltage source and the third switching circuit being connected in parallel to a series circuit having the first voltage source, the first switching circuit, the inductance component and the forward diode, and when the resonance voltage reaches a given voltage level higher than the voltage level of the sustain voltage and lower than the maximum voltage level of the resonance voltage, the first switching circuit is switched off while the third switching circuit is switched on, and after a predetermined period of time, the third switching circuit is switched off while the second switching circuit is switched on.

* * * * *